US010309708B2

(12) United States Patent
Jeong et al.

(10) Patent No.: US 10,309,708 B2
(45) Date of Patent: Jun. 4, 2019

(54) REFRIGERATOR HAVING A ROTATABLE DOOR FOR THE ICE MAKING COMPARTMENT FORMING THE EXTERIOR APPEARANCE

(71) Applicant: Samsung Electronics Co., Ltd., Suwon-si (KR)

(72) Inventors: Jin Jeong, Yongin-si (KR); Do Yun Jang, Busan (KR); Bong Su Son, Cheonan-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 527 days.

(21) Appl. No.: 14/724,133

(22) Filed: May 28, 2015

(65) Prior Publication Data

US 2016/0084560 A1 Mar. 24, 2016

(30) Foreign Application Priority Data

Sep. 23, 2014 (KR) ..... 10-2014-0126657
Jan. 9, 2015 (KR) ..... 10-2015-0003630

(51) Int. Cl.
*F25C 5/18* (2018.01)
*F25C 5/20* (2018.01)
(Continued)

(52) U.S. Cl.
CPC ..... *F25C 5/22* (2018.01); *F25C 5/24* (2018.01); *F25D 11/02* (2013.01); *F25D 23/028* (2013.01);
(Continued)

(58) Field of Classification Search
CPC ..... F25C 5/007; F25D 17/065; F25D 23/069; F25D 23/02; F25D 23/064; F25D 2201/10; F25D 2323/023
See application file for complete search history.

(56) References Cited

U.S. PATENT DOCUMENTS 5,603,230 A 2/1997 Tsai
6,490,874 B2 * 12/2002 Chu ..... H05K 5/0213 62/271
(Continued)

FOREIGN PATENT DOCUMENTS

CN 1683862 10/2005
CN 1683876 10/2005
(Continued)

OTHER PUBLICATIONS

Extended European Search Report dated Jan. 22, 2016 in European Patent Application No. 15168710.0.
(Continued)

*Primary Examiner* — Filip Zec
(74) *Attorney, Agent, or Firm* — Staas & Halsey LLP

(57) ABSTRACT

A refrigerator includes a body, a refrigerating compartment provided inside the body, a freezing compartment positioned at a lower portion of the refrigerating compartment and provided inside the body, an ice-making compartment provided inside the body and provided with an insulated space that is separated from the refrigerating compartment and the freezing compartment, and an ice-making compartment door to insulate the ice-making compartment from an outside and rotatably installed at the body as to open/close the ice-making compartment. Cooling efficiency is improved by completely separating the ice-making compartment from the freezing compartment and the refrigerating compartment, and user convenience is improved by separately installing the ice-making compartment door.

13 Claims, 16 Drawing Sheets

(51) Int. Cl.
*F25D 11/02* (2006.01)
*F25D 23/02* (2006.01)
*F25D 23/06* (2006.01)

(52) U.S. Cl.
CPC ..... *F25D 23/069* (2013.01); *F25D 2201/10* (2013.01); *F25D 2323/023* (2013.01)

(56) References Cited

U.S. PATENT DOCUMENTS

| | | | | |
|---|---|---|---|---|
| 6,745,578 | B2 * | 6/2004 | Collins | F25C 5/187 62/137 |
| 6,817,064 | B2 * | 11/2004 | Kim | E05D 11/105 16/335 |
| 7,707,847 | B2 | 5/2010 | Davis | |
| 8,191,379 | B2 * | 6/2012 | Wuesthoff | F25C 5/005 312/404 |
| 8,875,538 | B2 * | 11/2014 | Lee | F25D 23/02 62/389 |
| 9,074,810 | B2 * | 7/2015 | Hwang | F25D 23/02 |
| 2001/0037657 | A1 | 11/2001 | Dasher | |
| 2004/0187516 | A1 * | 9/2004 | Lee | F25C 5/22 62/389 |
| 2006/0162369 | A1 * | 7/2006 | Chae | F25D 11/02 62/340 |
| 2007/0119193 | A1 | 5/2007 | Davis et al. | |
| 2009/0199481 | A1 * | 8/2009 | Kluge | E05D 15/36 49/260 |
| 2010/0043478 | A1 | 2/2010 | Kim | |
| 2011/0146325 | A1 * | 6/2011 | Lee | F25C 5/005 62/344 |
| 2011/0146326 | A1 | 6/2011 | Choi | |
| 2012/0031136 | A1 * | 2/2012 | Park | F25D 11/02 62/340 |
| 2012/0043873 | A1 * | 2/2012 | Jeon | F25D 23/028 312/405.1 |
| 2012/0103002 | A1 * | 5/2012 | Lee | F25D 23/02 62/389 |
| 2014/0000303 | A1 | 1/2014 | Jeong et al. | |

FOREIGN PATENT DOCUMENTS

| | | | |
|---|---|---|---|
| CN | 1811308 | | 8/2006 |
| CN | 201540006 | | 8/2010 |
| CN | 102116562 | | 7/2011 |
| CN | 102395845 | | 3/2012 |
| CN | 102395848 | | 3/2012 |
| CN | 102494480 | | 6/2012 |
| CN | 102597666 | | 7/2012 |
| CN | 103512295 | | 1/2014 |
| EP | 2431693 | | 3/2012 |
| JP | 2001-24896 | | 9/2001 |
| JP | 2001-248961 | | 9/2001 |
| JP | 2003-287364 | | 10/2003 |
| KR | 10-2006-0085985 | | 7/2006 |
| KR | 10-2010-0116742 | | 11/2010 |
| KR | 10-2011-0089790 | | 8/2011 |
| KR | 10-2014-0001465 | | 1/2014 |
| WO | 2004/029528 | | 4/2004 |
| WO | WO-2004029528 | A1 * | 4/2004 |

OTHER PUBLICATIONS

Chinese Office Action dated Jun. 2, 2017 in Chinese Patent Application No. 201510455517.4.
Chinese Office Action dated Jan. 19, 2018 in Chinese Patent Application No. 201510455517.4.
Korean Office Action dated Jun. 20, 2018 in Korean Patent Application No. 10- 2015-0003630.
European Communication dated Dec. 20, 2018 in European Patent Application No. 15168710.0.
US Office Action dated Mar. 27, 2019 in U.S. Appl. No. 16/119,079.
Chinese Office Action dated Dec. 26, 2018 in Chinese Patent Application No. 201510455517.4.
Korean Notice of Allowance dated Dec. 28, 2018 in Korean Patent Application No. 10-2015-0003630.

* cited by examiner

REFRIGERATOR HAVING A ROTATABLE DOOR FOR THE ICE MAKING COMPARTMENT FORMING THE EXTERIOR APPEARANCE

CROSS-REFERENCE TO RELATED APPLICATIONS

This application claims the priority benefit of Korean Patent Application No. 10-2014-0126657, filed on Sep. 23, 2014, and Korean Patent Application No. 10-2015-0003630, filed on Jan. 9, 2015, in the Korean Intellectual Property Office, the disclosures of which are incorporated herein by reference.

BACKGROUND

1. Field

The following description relates to a refrigerator, and more particularly, a refrigerator having an ice-making compartment.

2. Description of the Related Art

In general, a refrigerator is an apparatus configured to store foods at a low temperature. The refrigerator includes a freezing compartment at which food are stored at relatively low temperature, and a refrigerating compartment at which foods are stored at relatively high temperature relative to the freezing compartment.

Cool air supplied to the freezing compartment and the refrigerating compartment may be generated by use of the heat-exchanging effect of refrigerant. The refrigerant may be heat-exchanged with air by sequentially circulating refrigerant in a refrigerant cycle of compression, condensation, expansion, and evaporation. By supplying the air that is heat-exchanged with respect to the refrigerant to the freezing compartment and the refrigerating compartment through a circulating fan, the foods inside the refrigerator may be stored at a desired temperature.

The refrigerator may be provided having the freezing compartment positioned at an upper portion thereof and the refrigerating compartment positioned at a lower portion thereof, or having the freezing compartment positioned at a lower portion thereof and the refrigerating compartment positioned at an upper portion thereof. In addition, the refrigerator may be provided in various configurations, such as having the freezing compartment and the refrigerating compartment provided at a left side and a right side thereof.

In addition, other than the freezing compartment and the refrigerating compartment, an ice-making compartment configured to make and store ice may be provided in the refrigerator. In general, the ice-making compartment is positioned in the freezing compartment or the refrigerating compartment and is configured to make ice by use of cool air that is heat-exchanged by an evaporator. Thus, the efficiency in making ice is lowered, and as the freezing compartment and the refrigerating compartment are not completely insulated from the ice-making compartment, the temperature at each compartment may be difficult to control.

SUMMARY

Therefore, it is an aspect of the present disclosure to provide a refrigerator having an ice-making compartment independently provided from a freezing compartment and a refrigerating compartment.

It is an aspect of the present disclosure to provide an ice-making compartment having an ice-making unit configured to make ice by being directly cooled by use of a refrigerant pipe.

Additional aspects of the disclosure will be set forth in part in the description which follows and, in part, will be obvious from the description, or may be learned by practice of the disclosure.

In accordance with an aspect of the present disclosure, a refrigerator may include a body, a refrigerating compartment, a freezing compartment, an ice-making compartment, and an ice-making compartment door. The refrigerating compartment may be provided inside the body. The freezing compartment may be positioned at a lower portion of the refrigerating compartment and provided inside the body. The ice-making compartment may be provided inside the body and provided with an insulated space that is separated from the refrigerating compartment and the freezing compartment. The ice-making compartment door may be configured to insulate the ice-making compartment from outside the refrigerator and rotatably installed on the body to open/close the ice-making compartment.

The refrigerator may further include a refrigerating compartment door rotatably installed on the body to open/close the refrigerating compartment, and a freezing compartment door slidably installed on the body to open/close the freezing compartment.

The ice-making compartment door and the refrigerating compartment door may be disposed parallel to each other, and the freezing compartment door is disposed at lower portions of the ice-making compartment door and the refrigerating compartment door.

The refrigerator may further include a dispenser door installed to open/close at least a portion of the refrigerating compartment and at which a dispenser provided to communicate with the ice-making compartment is installed.

The dispenser door may be disposed at a lower portion of the ice-making compartment door, so that the ice generated at the ice-making compartment is moved to the dispenser.

The ice-making compartment door and the dispenser door each may be rotatably installed on the body.

The refrigerator may further include brackets connecting the ice-making compartment door and the dispenser door to the body, and the brackets comprise a connecting bracket disposed between the ice-making compartment door and the dispenser door.

The connecting bracket may include a first rotating shaft rotatably coupled to the ice-making compartment door and a second rotating shaft rotatably coupled to the dispenser door.

The ice-making compartment door and the dispenser door may each include a gasket extended along borders of the ice-making compartment door and the dispenser door.

The ice-making compartment door and the dispenser door may be installed on the body to be rotated together.

The refrigerator may further include an accommodation unit positioned at a lower surface of the dispenser door and slidably installed at the refrigerating compartment.

An ice-making unit provided to generate ice and a refrigerant pipe provided to directly supply cooling energy to the ice-making unit may be disposed inside the ice-making compartment.

The refrigerating compartment door may include a first door having an opening provided with at least one door pocket, and a second door disposed on a front of the first door to open/close the opening.

In accordance with an aspect of the present disclosure, a refrigerator may include a storage compartment, an ice-making compartment, an ice-making compartment door, an ice-making unit, and a refrigerant pipe. The storage compartment may have a refrigerating compartment and a freezing compartment. The ice-making compartment may be provided as an independent space from the storage compartment. The ice-making compartment door may be provided to form at least a portion of an exterior appearance of the refrigerator and provided to open/close the ice-making compartment. The ice-making unit may be disposed inside the ice-making compartment and provided such that ice is generated. The refrigerant pipe may be configured to directly supply cooling energy to the ice-making unit while at least a portion of the refrigerant pipe is disposed inside the ice-making compartment.

The ice-making compartment may be provided to be insulated from the storage compartment.

The refrigerator may further include a refrigerating compartment door and a freezing compartment door to open/close the refrigerating compartment and the freezing compartment, respectively, and the refrigerating compartment door, the freezing compartment door, and the ice-making compartment door may form an exterior appearance of the refrigerator.

In accordance with an aspect of the present disclosure, a refrigerator may include a body, a storage compartment, an ice-making compartment, a first door, a second door, and an ice-making compartment door. The storage compartment may be formed inside the body. The ice-making compartment may form an insulated space separated from the storage compartment and provided inside the body. The first door may be installed on the body to open/close the storage compartment and have an opening provided with at least one door pocket. The second door may be disposed at a front of the first door to open/close the opening and provided to form at least a portion of a front exterior appearance of the body. The ice-making compartment door may be installed in the body to open/close the ice-making compartment and provided to form at least a portion of a front exterior appearance of the body.

The first door, the second door, and the ice-making compartment door may each be rotatably installed at the body.

In accordance with an aspect of the present disclosure, a refrigerator may include a body, an ice-making compartment, a door, and an ice-making compartment door. The body may be provided with a storage compartment inside thereof. The ice-making compartment may be provided inside the storage compartment to have an independent space from the storage compartment. The door may be rotatably installed in the body to open/close the storage compartment. The ice-making compartment door may be rotatably installed between the door and the body to open/close the ice-making compartment.

The ice-making compartment door may be rotatably installed on at least one of the door and the body.

An ice-making compartment door mounting space in which the ice-making compartment door is mounted while facing the ice-making compartment may be provided at an inside wall of the door.

A gasket may be installed on at least one of the ice-making compartment and the ice-making compartment door to seal the ice-making compartment.

A rotational shaft of the door and a rotational shaft of the ice-making compartment door may be positioned at a coaxial line.

The refrigerator may further include a bracket to form a rotational shaft so that the door and the ice-making compartment door are rotated while having the coaxial line, and to connect the body to at least one of the door and the ice-making compartment door.

The bracket may include a first body fixed at the body and having a fastening hole, and a second body connecting the door to the ice-making compartment door while fastened to the coupling hole, and forming the rotational shaft.

The door may form an overall external appearance by being coupled to the body.

An inside wall of the door may include a first domain at which the ice-making compartment door is mounted to face the ice-making compartment, a second domain at which the at least one door pocket is disposed, and a partition wall to divide the first domain and the second domain so that the first domain and the second domain are isolated from each other.

At the second domain, a gasket may be installed along a border of the second domain so that the storage compartment is sealed.

The storage compartment may include a refrigerating compartment and a freezing compartment. The refrigerator may further include: a refrigerating compartment door rotatably installed in the body to open/close the refrigerating compartment and having the ice-making compartment door disposed between the refrigerating door and the body; and a freezing compartment door slidably installed at the body to open/close the freezing compartment.

The freezing compartment door may be disposed at a lower portion of the refrigerating compartment door.

In accordance with an aspect of the present disclosure, a refrigerator may include a body provided with a freezing compartment and a refrigerating compartment inside thereof, an ice-making compartment provided inside the refrigerating compartment to have an independent space from the freezing compartment and the refrigerating compartment, a refrigerating compartment door rotatably provided in the body to open/close the refrigerating compartment, and a plurality of ice-making compartment doors provided between the refrigerating door and the body to open/close the ice-making compartment.

The plurality of ice-making compartment doors may include a first door detachably installed in the ice-making compartment. The second door may be rotatably installed on at least one of the refrigerating compartment door and the body to face the first door.

The plurality of ice-making compartment doors may include a first door slidably coupled to the ice-making compartment, and a second door rotatably installed on at least one of the refrigerating compartment door and the body.

The rotational shaft of the refrigerating compartment door and the rotational shaft of the second door may be positioned at a coaxial line.

The second door may be installed as to be separately rotated with respect to the refrigerating compartment door.

A gasket may be installed on at least one of the plurality of ice-making compartment doors and the ice-making compartment to seal the ice-making compartment.

The refrigerator may further include a freezing compartment door slidably installed in the body to open/close the freezing compartment. The refrigerating compartment door, the freezing compartment door, and the body may form an overall external appearance by being coupled to each other.

The freezing compartment door may be disposed at a lower portion of the refrigerating compartment door

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
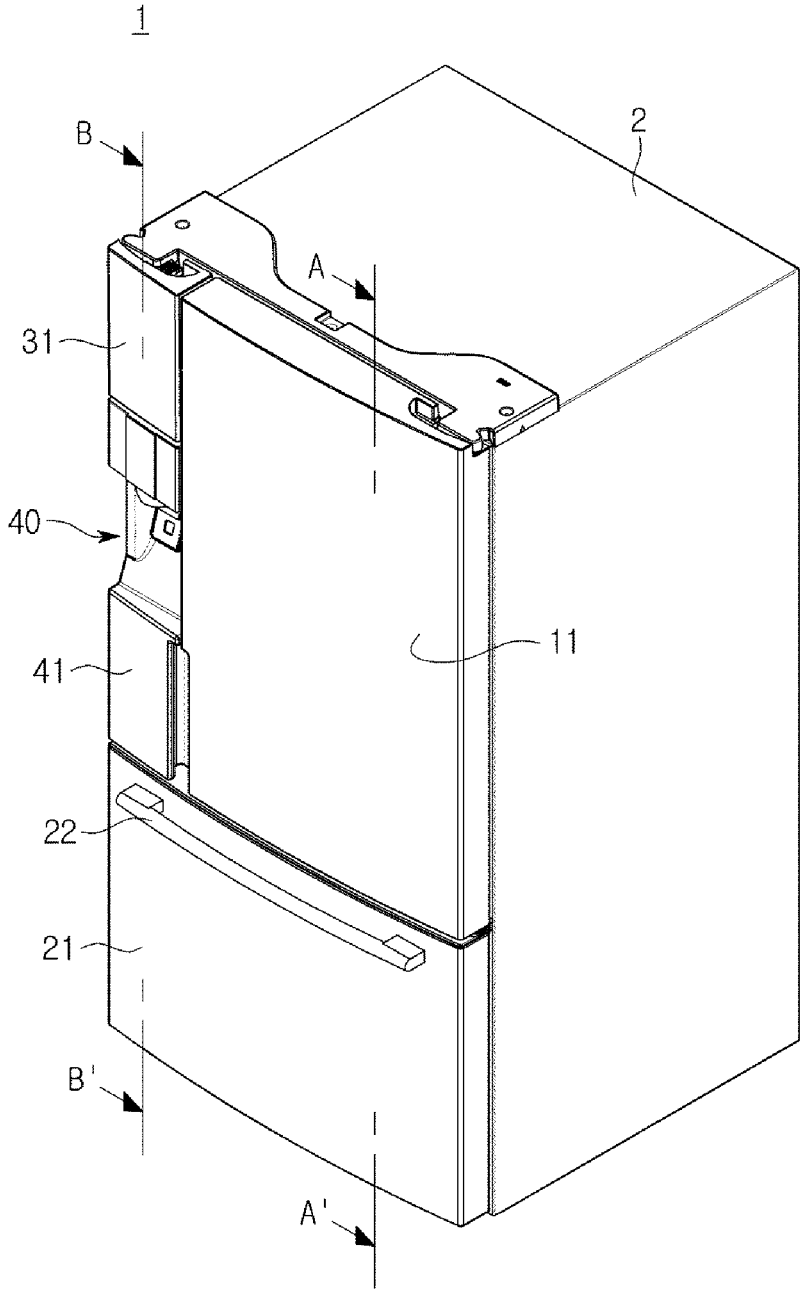
FIG. 1 is a drawing illustrating a refrigerator in accordance with an embodiment of the present disclosure.

Reference will now be made in detail to the embodiments of the present disclosure, examples of which are illustrated in the accompanying drawings, wherein like reference numerals refer to like elements throughout.

Figure 2:
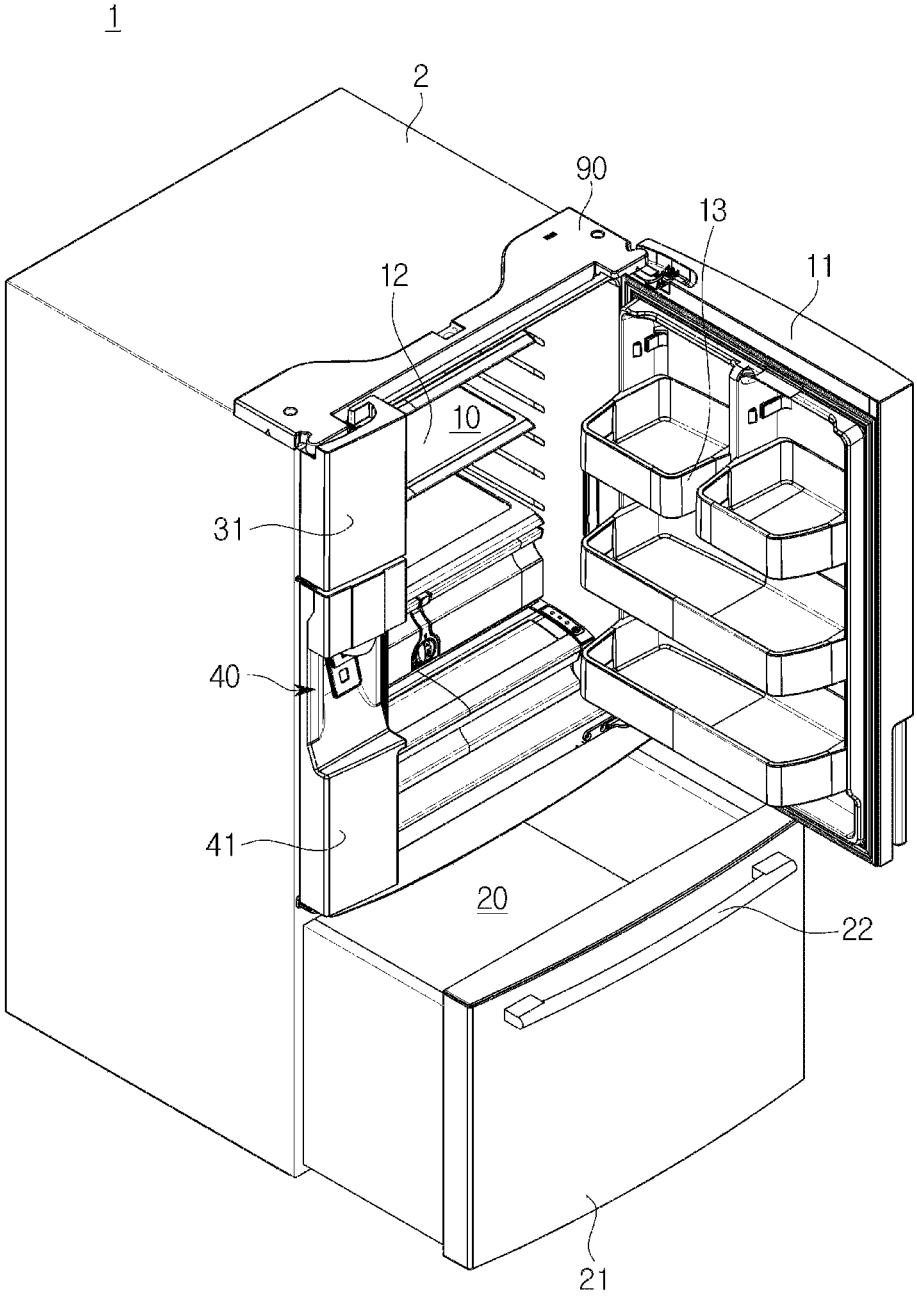
FIG. 2 is a drawing illustrating an open status of a refrigerating compartment door and a freezing compartment door of the refrigerator in accordance with an embodiment of the present disclosure.
Figure 3:
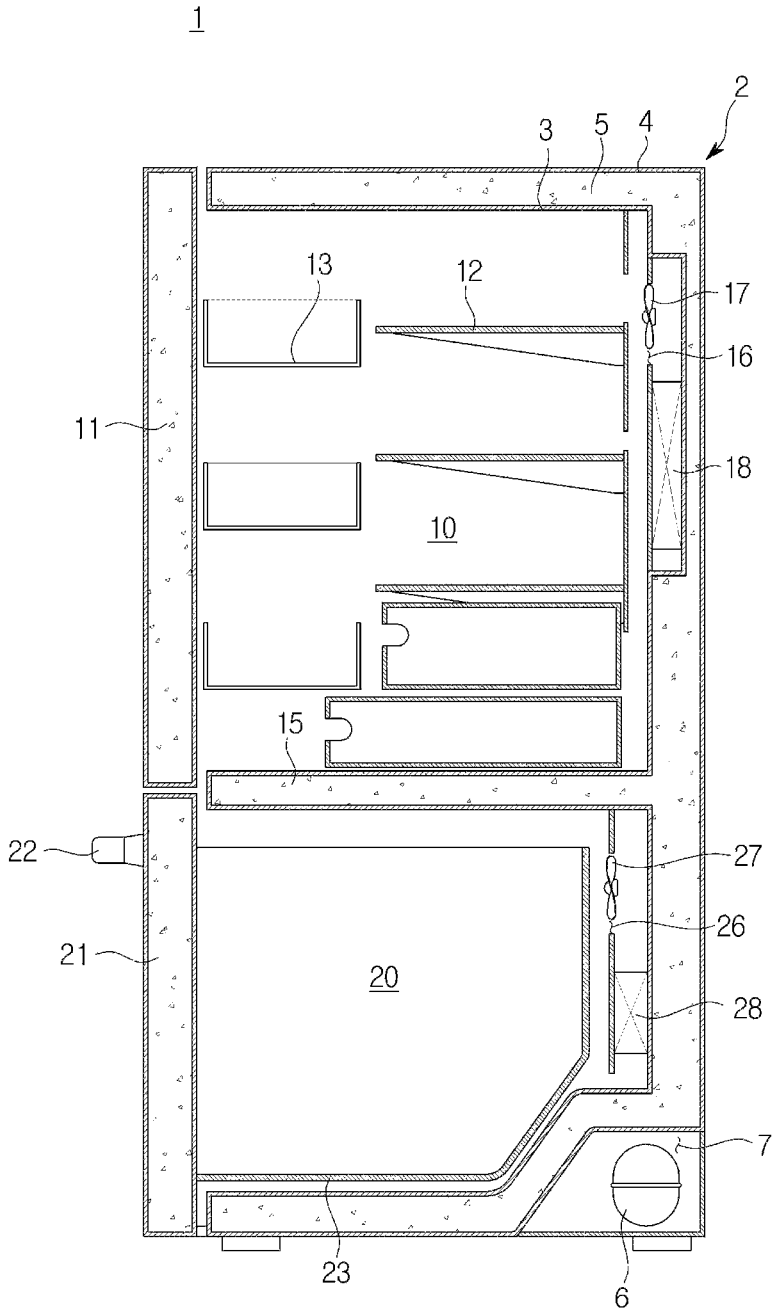
FIG. 3 is a drawing illustrating an A-A' cross section of FIG. 1.

FIG. 1 is a drawing illustrating a refrigerator in accordance with an embodiment of the present disclosure, FIG. 2 is a drawing illustrating an open status of a refrigerating compartment door and a freezing compartment door of the refrigerator in accordance with an embodiment of the present disclosure, and FIG. 3 is a drawing illustrating an A-A' cross section of FIG. 1. For convenience sake of description, components of a refrigerator are schematically illustrated.

A refrigerator 1 may include a body 2 forming an external appearance. The body 2 may include an inside case 3, and an outside case 4 coupled to an outside of the inside case 3.

The inside case 3 and the outside case 4 may form an inside space while spaced apart with respect to each other by a predetermined space. Insulating material 5 may be disposed in the inside space. The insulating material may be provided as foamed urethane foam. The insulating material 5 may be formed by foaming and hardening urethane concentrated solution after the urethane solution is injected into the inside space 5 formed after the inside case 3 and the outside case 4 are coupled to each other.

In addition, the refrigerator 1 may include storage compartments 10 and 20 formed inside the body 2. The inside case 3 may form the storage compartments 10 and 20, and may be molded by use of resin material. In addition, the outside case 4 is provided to form an external appearance of the refrigerator 1, and may be formed by use of metallic material to be provided with finish and durability.

The storage compartments 10 and 20 may store foods while provided inside the body 2. The storage compartments 10 and 20 may be divided vertically with a storage partition 15.

The storage compartments 10 and 20 divided by the storage partition 15 may include a refrigerating compartment 10 to refrigerate and store foods, and a freezing compartment 20 to freeze and store foods. The refrigerating compartment 10 and the freezing compartment 20 may each be provided with a front surface thereof open to insert/remove food into/from by a user.

As illustrated on FIGS. 1 to 3, the freezing compartment 20 may be positioned at a lower portion of the refrigerating compartment 10, and the refrigerator as such is referred to a BMF (Bottom Mounted Freezer) refrigerator, and hereinafter, the descriptions will be provided with embodiments of the BMF refrigerator as such.

Doors 11 and 21 configured to open/close the storage compartments 10 and 20 may be provided at front openings of the storage compartments 10 and 20. The doors 11 and 21 may include a refrigerating compartment door 11 and a freezing compartment door 21 provided at front surfaces of the refrigerating compartment 10 and the freezing compartment 20, respectively.

The refrigerating compartment door 11 and the freezing compartment door 21 may be coupled to the body 2 to open/close the refrigerating compartment 10 and the freezing compartment 20, respectively. As illustrated on FIG. 2, the refrigerating compartment door 11 may open/close the refrigerating compartment 10 while installed in the body 2. In addition, as illustrated on FIG. 2, the freezing compartment door 21 may open/close the freezing compartment 20 while installed in the body 2.

At least one shelf 12 provided to organize the refrigerating compartment 10 into several shelves so that the storing of stored material may be convenient. In addition, at least one door pocket 13 provided to accommodate stored material may be provided on an inner wall of the refrigerating compartment door 11.

A freezing box 23 may be installed in the freezing compartment 20 to store stored material. The freezing box 23 may be coupled to the freezing compartment door 21 so that the freezing box 23 may be slidably moved along with the freezing compartment door 21. In addition, a handle 22 may be provided at a front surface of the freezing compartment door 21 for a user to grab.

At least one of inlet unit 16 and 26 through which cool air is inlet may be provided at each of the storage compartments 10 and 20. The cool air inlet through the inlet units 16 and 26 may maintain the temperature of stored material by heat-exchanging with the stored material. Circulating fans 17 and 27 may each be installed at one side of the storage compartments 10 and 20, respectively, to circulate the cool air.

In addition, evaporators 18 and 28 to each heat-exchange with air may be installed at one side of the storage compartments 10 and 20, respectively. The evaporators 18 and 28 are fixedly installed on one side of the inner case 3. The evaporators 18 and 28 may form a refrigerant cycle while connected to a compressor 6. The compressor 6 may be disposed inside a machinery room 7 formed at a lower portion of the body 2.

The evaporators 18 and 28 are capable of lowering the temperature of surrounding air by taking away the heat from the surrounding air. The moisture included in the surrounding air may be condensed during the heat-exchanging process, and may be formed at surfaces of the evaporators 18 and 28. The refrigerator 1 may be provided with a drain apparatus (not shown) to process the condensed water as such.

Figure 4:
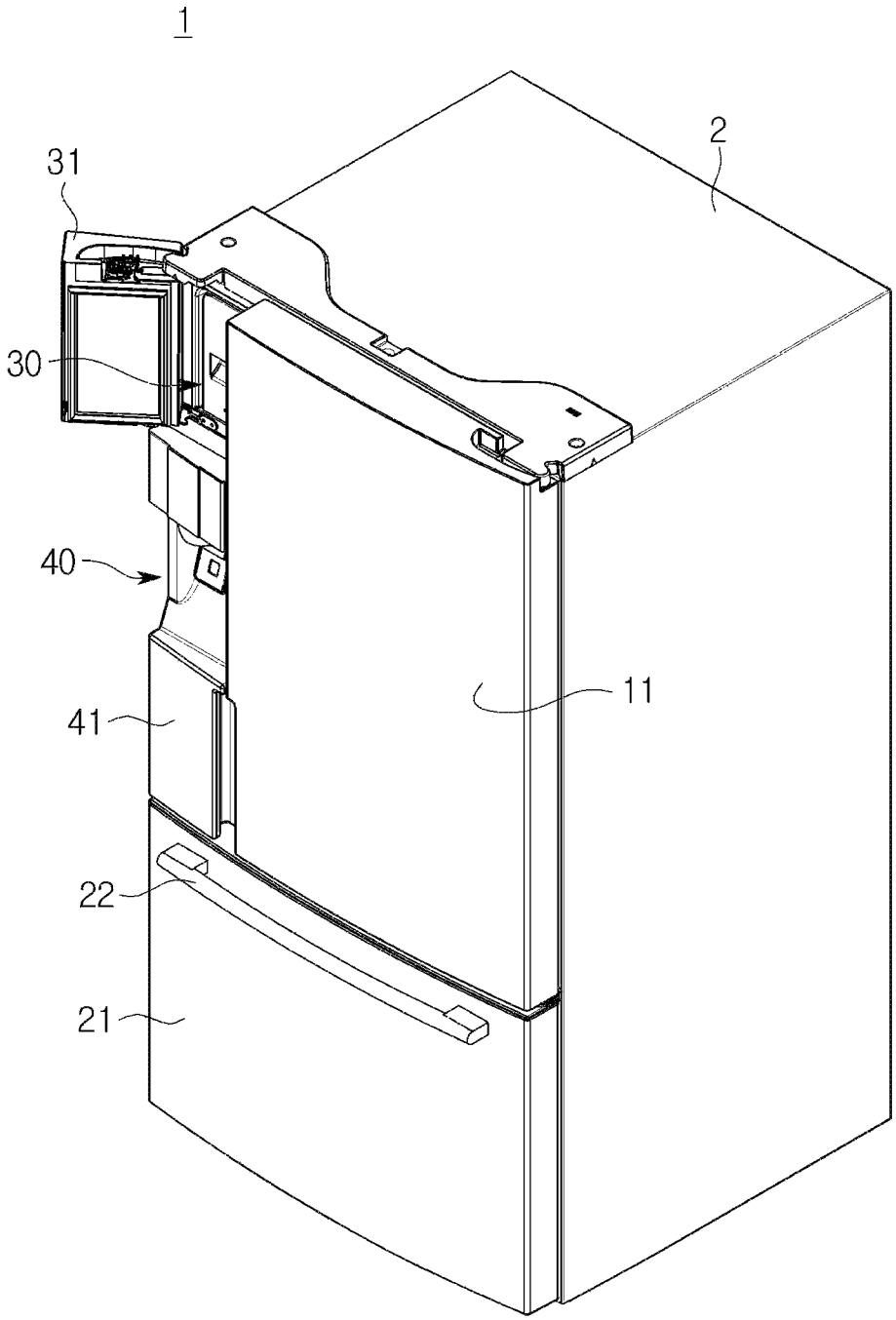
FIG. 4 is a drawing illustrating an open status of an ice-making compartment door of the refrigerator in accordance with an embodiment of the present disclosure.

FIG. 4 is a drawing illustrating an open status of an ice-making compartment door of the refrigerator in accordance with an embodiment of the present disclosure.

The refrigerator 1 may include an ice-making compartment 30 separated from the storage compartments 10 and 20 and provided inside the body 2. The ice-making compartment 30 may be formed as an insulated space separated from the storage compartments 10 and 20. In addition, the ice-making compartment 30 may be open/closed by use of an ice-making compartment door 31. That is, the ice-making compartment 30 may be provided as an independent compartment with respect to the refrigerating compartment 10 and the freezing compartment 20.

As illustrated on FIG. 1, the ice-making compartment door 31 together with the refrigerating compartment door 11 and the freezing compartment door 21 may form an external appearance of the refrigerator 1. That is, the ice-making compartment door 31 may be installed to insulate the outside of the body 2 from the ice-making compartment 30. As illustrated in FIG. 4, the ice-making compartment door 31 may be rotatably installed at the body 2 to open/close the ice-making compartment 30.

In addition, the refrigerator 1 may include a dispenser 40 to extract and withdraw the ice that is made at the ice-making compartment 30. The dispenser 40 may be installed at a front surface of the refrigerating compartment 10 to be communicated with the ice-making compartment 30. Hereinafter, a door at which the dispenser 40 is installed is referred to as a dispenser door 41.

As for the ice generated at the ice-making compartment 30 to be moved to the dispenser 40, the dispenser door 41 may be disposed at a lower portion of the ice-making compartment door 31. The ice-making compartment door 31 and the dispenser door 41 each may be rotatably installed on the body 2 to be rotated individually. In addition, the ice-making compartment door 31 and the dispenser door 41 may be installed on the body 2 to be rotated together.

The ice-making compartment door 31 and the dispenser door 41 may include gaskets extended along borders of the ice-making compartment door 31 and the dispenser door 41, respectively. Even in a case when the ice-making compartment door 31 and the dispenser door 41 are provided to be rotated together, the gasket may be provided at each of the ice-making compartment door 31 and the dispenser door 41.

FIG. 4 is provided to illustrate an example of the ice-making compartment door 31 and the dispenser door 41 each rotatably installed to be rotated individually. With respect to the rotations of the ice-making compartment door 31 and the dispenser door 41, the descriptions will be provided later on FIG. 10.

As illustrated on FIG. 1, the ice-making compartment door 31 and the refrigerating compartment door 11 may be parallelly disposed with respect to each other, and the freezing compartment door 11 may be disposed at a lower portion of the ice-making compartment door 31 and the refrigerating compartment door 11. To be more in detail, the ice-making compartment door 31 and the dispenser door 41 are disposed vertically, and the ice-making compartment door 31, the dispenser door 41, and the refrigerating compartment door 11 are evenly disposed.

Figure 5:
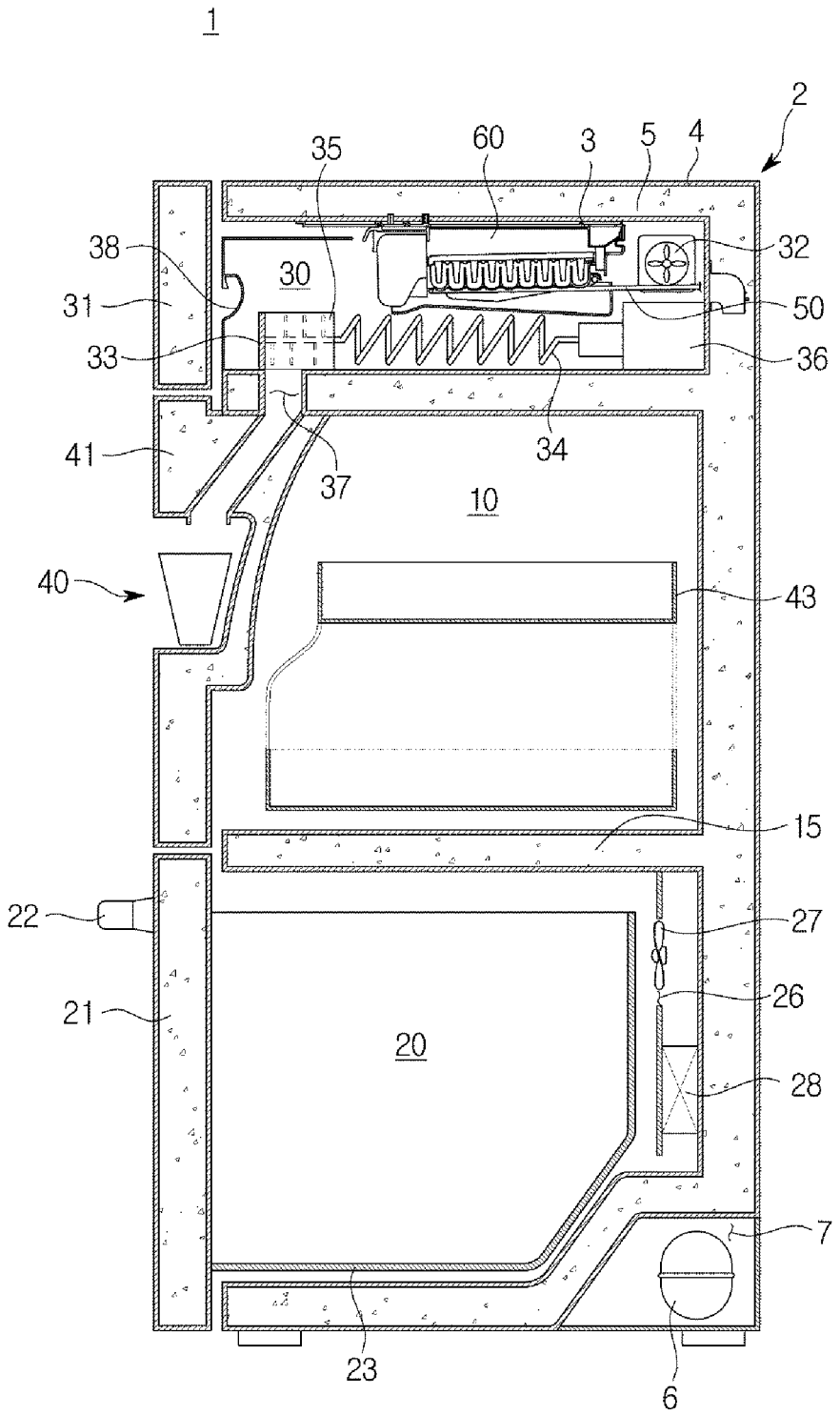
FIG. 5 is a drawing illustrating a B-B' cross section of FIG. 1.

FIG. 5 is a drawing illustrating a B-B' cross section of FIG. 1. For the convenience of providing descriptions, FIG. 5 is provided to illustrate the structuring elements of the refrigerator.

As described above, the dispenser door 41 is disposed below the ice-making compartment door 31. In addition, the freezing compartment door 21 may be disposed below the dispenser door 41.

The refrigerating compartment 10 being open/closed by use of the dispenser door 41 is connectively provided to the refrigerating compartment 10 being open/closed by use of the refrigerating compartment door 11. Thus, as described on FIG. 2, the shelf 12 and the door pocket 13 may be disposed.

In addition, a space of the refrigerating compartment 10 open/closed by use of the dispenser door 41 may be separated from another space of the refrigerating compartment 10 open/closed by use of the refrigerating compartment door 11 by a partition wall (not shown). The refrigerating compartment 10 may be formed as a storage space having various temperature ranges, by insulating the two spaces from each other.

In addition, as illustrated on FIG. 5, an accommodation unit 43 may be provided at a rear side of the dispenser door 41. The accommodation unit 43 may be slidably installed at the refrigerating compartment 10. The accommodation unit 43 may be slidably installed while communicated with the rotation of the dispenser door 41.

An ice-making unit 60 is provided such that ice is generated, and a refrigerant pipe 50 to directly supply cooling energy to the ice-making unit 60 may be disposed inside the ice-making compartment 30. At least a portion of the refrigerant pipe 50 may be disposed inside the ice-making compartment 30 to directly supply cooling energy to the ice-making unit 60. That is, the ice-making compartment 30 in accordance with an embodiment of the present disclosure may generate ice by use of a direct cooling method.

An ice storage container 33 to store the ice generated by use of the ice-making unit 60 may be installed at the ice-making compartment 30. The ice stored at the ice storage container 33 may be moved to an ice-pulverizing apparatus 35 by use of a transferring apparatus 34 driven by a motor 36, and the ice pulverized by use of the ice-pulverizing apparatus 35 may be supplied to the dispenser 40 after passing through an ice discharging duct 37.

A handle unit 38 may be provided at a front surface of the ice storage container 33. In a case when a user is in need of a large quantity of ice, the user may grab the handle unit 38 to withdraw the ice storage container 33 from the ice-making compartment 30.

The refrigerant pipe 50 may be inserted into the ice-making compartment 30, and may be installed such that at least a portion thereof may be in contact with the ice-making unit 60. Thus, the refrigerant pipe 50 may be able cool the ice-making unit 60 by directly making contact with the ice-making unit 60.

In addition, an ice-making fan 32 to circulate the air of the ice-making compartment 30 may be installed at the ice-making compartment 30. As the ice-making fan 32 is provided to forcedly move the air of the ice-making compartment 30 toward the refrigerant pipe 50 or the ice-making unit 60, the air of the ice-making compartment 30 may be cooled by heat-exchanging with the refrigerant pipe 50 or the ice-making unit 60.

In addition, a driving unit 73 to drive the transferring apparatus 34 and the ice-making fan 32 may be included in the refrigerator. The driving unit 73 may include a motor to drive the transferring apparatus 34 and a motor to drive the ice-making fan 32.

The refrigerant pipe 50 is connected to the compressor 6 and the evaporators 18 and 28, and the refrigerant flowing at the refrigerant pipe 50 may be circulated in a cooling cycle. Hereinafter, the descriptions with respect to the ice-making unit 60 will be provided in detail.

Figure 6:
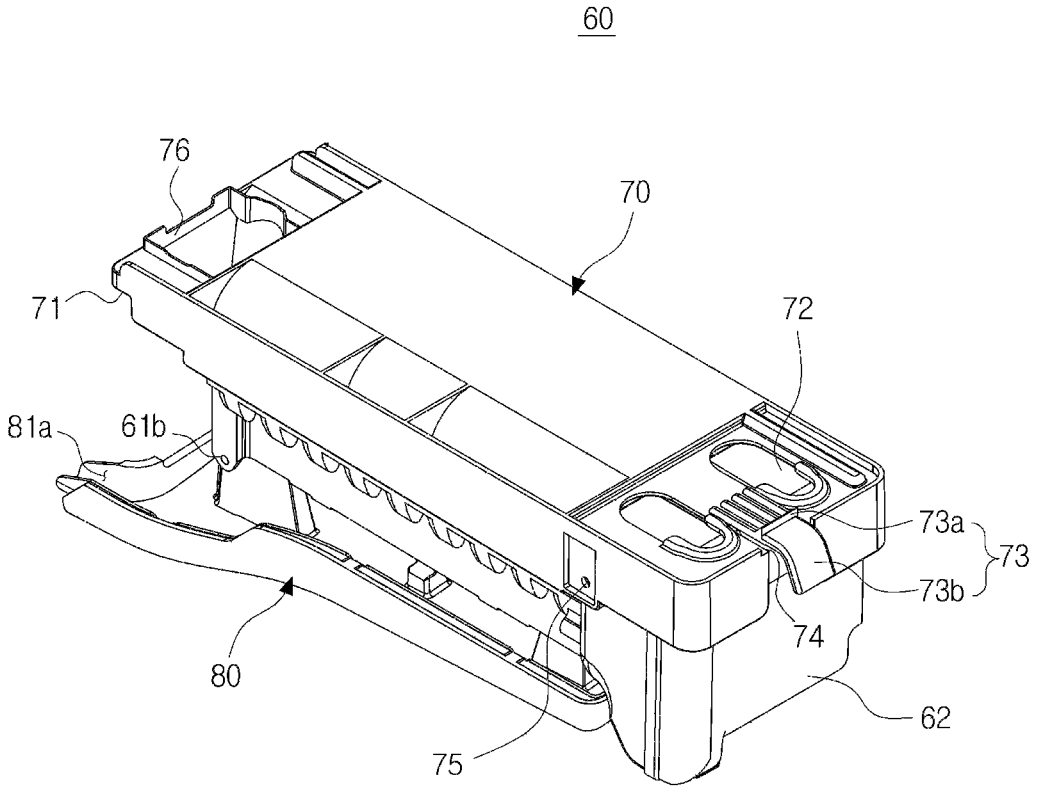
FIG. 6 is a drawing illustrating an ice-making unit of the refrigerator in accordance with an embodiment of the present disclosure.
Figure 7:
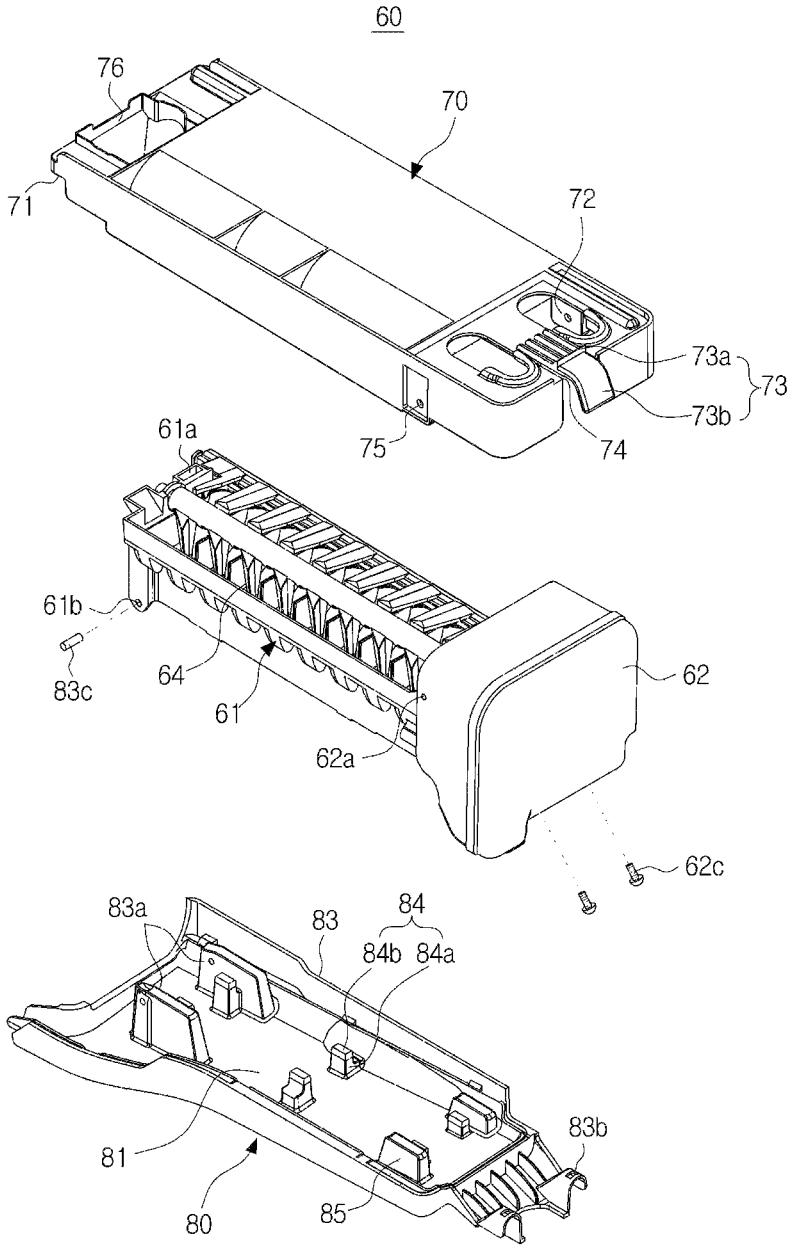
FIG. 7 is an exploded drawing illustrating the ice-making unit of the refrigerator in accordance with an embodiment of the present disclosure.
Figure 8:
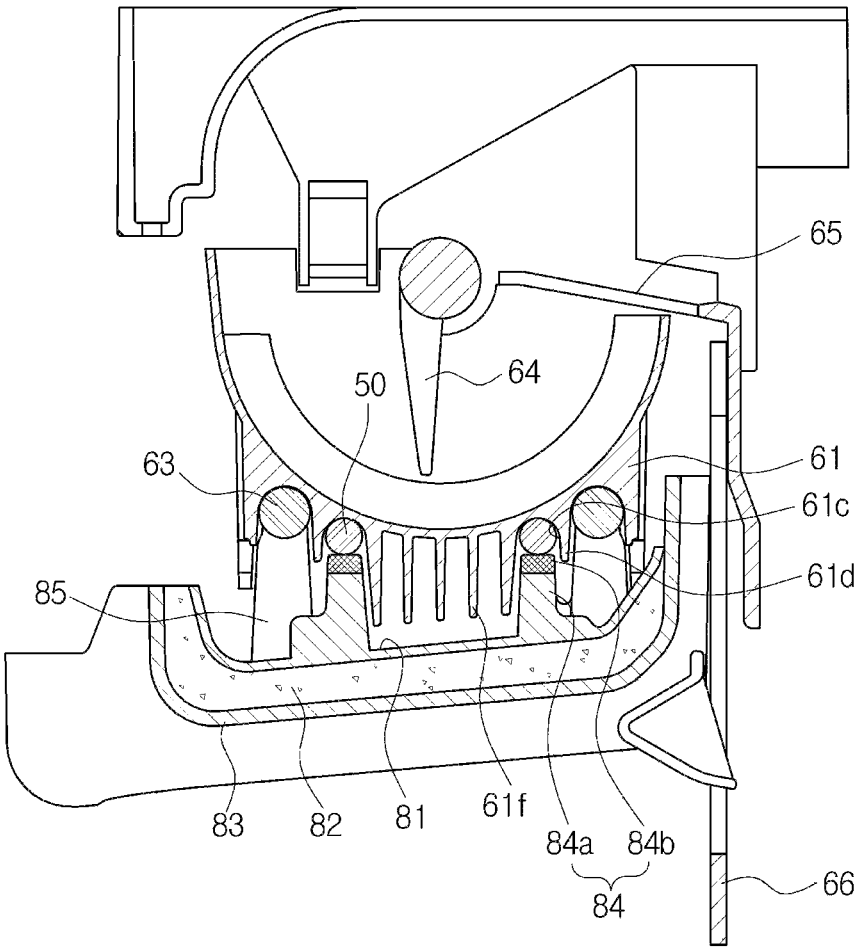
FIG. 8 is a drawing illustrating a cross section of the ice-making unit of the refrigerator in accordance with an embodiment of the present disclosure.
Figure 9:
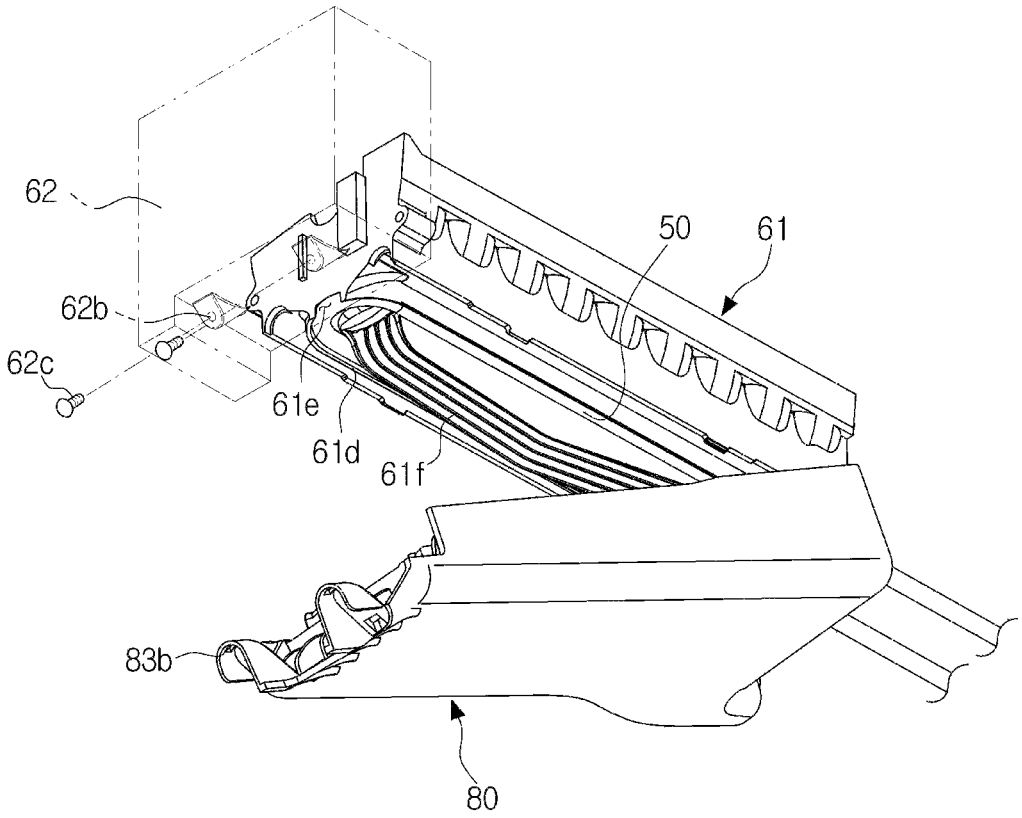
FIG. 9 is a drawing illustrating the ice-making unit and a refrigerant pipe of the refrigerator in accordance with an embodiment of the present disclosure.

FIG. 6 to FIG. 8 are drawings illustrating the ice-making unit of the refrigerator in accordance with an embodiment of the present disclosure, and FIG. 9 is a drawing illustrating the ice-making unit and a refrigerant pipe of the refrigerator in accordance with an embodiment of the present disclosure.

The ice-making unit 60 may be detachably installed in the ice-making compartment 30. The ice-making unit 60 may be fixed at a predetermined position of the ice-making compartment 30 by being coupled to an inner side surface of the ice-making compartment 30.

The ice-making unit 60 may include an ice-making tray 61, an electronic unit housing 62, a deicing heater 63, an ejector 64, a slider 65, and a full-ice detecting lever 66.

The ice-making tray 61 may be formed in a structure capable of storing water being supplied. The ice-making tray 61, if provided with the structure of making ice in a predetermined shape by freezing the water, is not limited to the structure thereof.

The deicing heater 63 may be installed at a lower portion of the ice-making tray 61. The deicing heater 63 may easily separate ice from the ice-making tray 61 by heating the ice-making tray 61. The deicing heater 63 may be formed in the shape of a letter U along an outer circumference of the ice-making tray 61.

In addition, a pipe seating unit 61*c* may be installed at a lower portion of the ice-making tray 61. The refrigerant pipe 50 may be mounted in the pipe seating unit 61*c*. The refrigerant pipe 50 may be formed in the shape of a letter U, and the pipe seating unit 61*c* may be formed in the shape of a letter U while corresponding to the shape of the refrigerant pipe 50.

At this time, the refrigerant pipe 50 and the deicing heater 63 may be installed not to be overlapped with each other. That is, the refrigerant pipe 50 formed in the shape of a letter U may be installed between the deicing heater 63 formed in the shape of a letter U. In addition, the refrigerant pipe 50 may be installed at a lower portion of the ice-making tray 61 lower than the deicing heater 63.

The heat of the deicing heater 63 may be prevented from being directly delivered to the refrigerant pipe 50, and the cooling energy of the refrigerant pipe 50 may be prevented from being directly delivered to the deicing heater 63.

In addition, a seating guide 61*d* may be formed around the borders of the pipe seating unit 61*c*. The seating guide 61*d* may be provided such that the refrigerant pipe 50 is easily mounted at the pipe seating unit 61*c* of the ice-making tray 61.

A detachment guiding groove 61*e* may be formed on the seating guide 61*d*. A user may easily detach the refrigerant pipe 50 from the pipe seating unit 61*c* of the ice-making tray 61 by inserting a tool into the detachment guiding groove 61*e*.

A heat-exchanging rib 61*f* may be formed at the ice-making tray 61. The heat-exchanging rib 61*f* may be formed on a bottom surface of the ice-making tray 61, and may be formed between the refrigerant pipe 50 having the shape of a letter U. The heat-exchanging rib 61*f* may have the cooling energy being delivered to the ice-making tray 61 and the surrounding air exchange heat.

That is, the cooling energy being delivered from the refrigerant pipe 50 to the ice-making tray 61 may be used to convert the water accommodated at the ice-making tray 61 into ice, and a portion of the cooling energy may be used as to cool the air of the ice-making compartment 30 through the heat-exchanging rib 61*f*.

The electronic unit housing 62 may be installed at one end of the ice-making tray 61. An electronic system capable of controlling the heating the deicing heater 63 or rotating the ejector 64 may be installed at the electronic unit housing 62.

The ejector 64 may be installed at an upper portion of the ice-making tray 61. The ejector 64 may move ice from the ice-making tray 61 to the slider 65 while rotating.

The slider 65 may be installed at one side of the ice-making tray 61. The slider 65 may perform a guiding function to move ice to the ice storage container 33. Ice may be descended while riding on the slider 65 to be accommodated at the ice storage container 33.

The full-ice detecting lever 66 may detect if ice is filled at the ice storage container 33. Therefore, the full-ice detecting lever 66 may be extendedly formed toward the ice storage container 33. If the full-ice detecting lever 66 detects the full ice at the ice storage container 33, the ice-making unit 60 may not generate ice any further.

In addition, the ice-making unit 60 may further include a supporter 70 and a drain duct 80.

The supporter 70 may be provided at an upper side of the ice-making tray 61. A front end of the supporter 70 may be coupled to the electronic unit housing 62 by use of a screw coupling structure. In addition, a rear end of the supporter 70 may be coupled to the ice-making tray 61 by use of a hook coupling structure.

The supporter 70 and the electronic unit housing 62 may be coupled to each other by use of a screw after matching a first screw groove 75 of the supporter 70 and a second screw groove 62*a* of the electronic unit housing 62. The supporter 70 and the ice-making tray 61 may be coupled to each other as a hook (not shown) of the supporter 70 is inserted into a hook groove 61*a* of the ice-making tray 61.

The supporter 70 by use of the coupling structure as such may sustain the ice-making unit 60. In addition, the supporter 70 may be integrally formed with the ice-making tray 61 or the electronic unit housing 62.

The ice-making unit 60 may be detachably provided at the ice-making compartment 30 by use of the coupling structure of the supporter 70 and the ice-making compartment 30. The supporter 70 and the ice-making compartment 30 may have at least one coupling structure, and in detail, the supporter 70 and the ice-making compartment 30 may have at least one support coupling structure, at least one hook coupling structure, and at least one locking structure.

A supporting unit 71 supportedly coupled to the supporter 70 and the ice-making compartment 30 may be included in the refrigerator. The ice-making compartment may include a seating unit provided to correspond with respect to the supporting unit 71. In addition, a groove unit 72 provided at an upper portion of the supporter 70 hook-coupled to the ice-making compartment may be included. The ice-making compartment 30 includes a hook unit (not shown) corresponding with the groove unit 72, and the ice-making unit 60 may be inserted into the ice-making compartment 30 so that the hook unit (not shown) may be inserted into the groove unit 72.

In addition, the supporter 70 may include a locking member 73 lock-coupled to the ice-making compartment 30. The locking member 73 may be elastically supported at the supporter 70 by use of an elastic incision unit 74. The locking member 73 may include a binding unit 73*a* inserted into a locking member accommodating unit (not shown) provided at the ice-making compartment 30 and a switch unit 73*b* provided to be elastically deformed while supporting the binding unit 73*a*. A user or a worker may vertically move the binding unit 73*a* by pressing the switch unit 73*b*.

The ice-making unit 60 may be coupled to the ice-making compartment 30 in a state that the movements toward forward/backward directions and upward/downward directions are limited. In addition, a user or a worker may release at least one of the coupling structures of the supporter 70, so that the ice-making unit 60 may be separated from the ice-making compartment 30.

Meanwhile, a water supplying tank 76 may be formed at the supporter 70. The water supplying tank 76 may be connected to an external water supply source (not shown). The water that is inlet from the external water supply source (not shown) may be supplied to the ice-making tray 61 through the water supplying tank 76.

The drain duct 80 may be provided at a lower side of the ice-making tray 61. The drain duct 80 may drain water to an outside of the ice-making compartment 30 after collecting the water descending from the ice-making tray 61 or the refrigerant pipe 50. In addition, the drain duct 80 may prevent frost from being formed.

The drain duct 80 and the ice-making tray 61 may include at least one rotation coupling structure. The at least one rotation coupling structure of the drain duct 80 and the ice-making tray 61 may include a hinge coupling.

A first hinge fastening unit 83*a* of the drain duct 80 and a second hinge fastening unit 61*b* of the ice-making tray 61 may be coupled to each other by use of a hinge shaft 83*c*. The drain duct 80 may be rotated with respect to the ice-making tray 61 while having the hinge shaft 83*c* as a center.

In addition, the drain duct 80 and the electronic unit housing 62 may include at least one locking structure. The at least one locking structure of the drain duct 80 and the electronic unit housing 62 may include a screw coupling. A first screw fastening unit 83*b* of the drain duct 80 and a second screw fastening unit 62*b* of the ice-making tray 61 may be coupled to each other by use of a screw 62*c*. At this time, the coupling direction of the screw 62*c* is provided in the shape of a spiral direction, and thus a user or a worker may screw-couple by use of a tool from outside the ice-making compartment 30.

The drain duct 80 may be provided to be supported without being moved at a lower side of the ice-making tray 61 through the at least one locking structure. A user or a worker, by releasing the at least one locking structure, may rotate the drain duct 80 so that the drain duct 80 may be spaced apart by a predetermined gap with the ice-making tray 61.

In addition, the drain duct 80 may include a sink 81, insulation material 82, a frost preventing cover 83, and a heat conductor 85.

The sink 81 is provided to collect the water descending from the ice-making tray 61 or the refrigerant pipe 50, and may be inclinedly formed so that the water collected as such may flow toward a draining unit 81*a*. In addition, the sink 81 may be formed of material having high heat conductivity. Therefore, when defrosting, the frozen water may be promptly drained by expediting heat transfer of the deicing heater 63.

Frost may be easily formed on the sink 81 due to material characteristic of the sink 81, and to prevent the phenomenon as such, the frost preventing cover 83 may be provided to surround the sink 81. In detail, the insulation material 82 is inserted between the sink 81 and the frost preventing cover 83 so that the heat transfer between the sink 81 and the frost preventing cover 83 may be blocked. The frost preventing cover 83 is formed by use of material having low heat conductivity such as plastic injection material so that the forming of frost at the sink 81 and the frost preventing cover 83 may be prevented.

In addition, the at least one heat conductor 85 may be installed at the sink 81. The heat conductor 85 may connect the sink 81 to the deicing heater 63. The heat conductor 85 may prevent the frost from forming at the sink 81 by delivering the heat of the deicing heater 63 to the sink 81.

The heat conductor 85 may be provided in a plurality of units according to the amount of the heat to be delivered to the sink 81. The heat conductor 85 may be formed by use of material having high heat conductivity. The heat conductor 85 may be formed by use of aluminum that is identical material as the sink 81.

The drain duct 80 may further include a fixer 84 to fix the refrigerant pipe 50 to the ice-making tray 61. The fixer 84 may fix the refrigerant pipe 50 to a lower portion of the ice-making tray 61 by closely attaching the refrigerant pipe 50 to the pipe seating unit 61*c* of the ice-making tray 61. The refrigerant pipe 50 may directly cool the ice-making tray 61 by making contact with the ice-making tray 61.

In addition, the fixer 84 may include a pressing unit 84*a* and an elastic unit 84*b*. The pressing unit 84*a* may be formed by use of copper that is identical material as the refrigerant pipe 50. Therefore, the refrigerant pipe 50 may be damaged in a case when the pressing unit 84*a* is provided to directly press the refrigerant pipe 50.

Therefore, the elastic unit 84*b* formed by use of rubber material may be provided to directly make contact with the refrigerant pipe 50. The elastic unit 84*b* may be deformed when making contact with the refrigerant pipe 50, and thus the elastic unit 84*b* may prevent the refrigerant pipe 50 from being damaged. In addition, the elastic unit 84*b* of rubber material is provided with low heat conductivity, and thus the cooling energy of the refrigerant pipe 50 being delivered to the drain duct 80 may be prevented. The forming of frost at the drain duct 80 may be prevented in advance.

Figure 10:
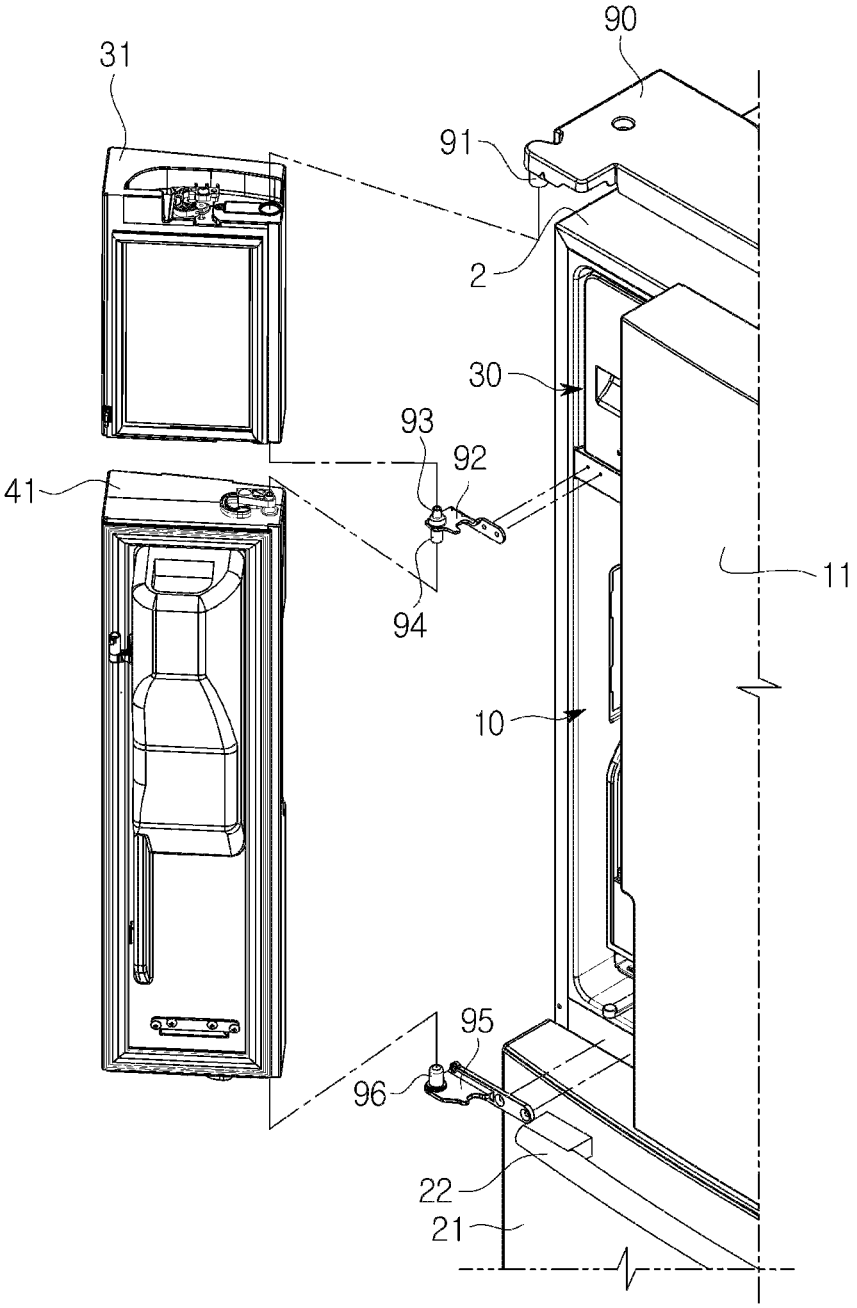
FIG. 10 is an exploded drawing illustrating doors and brackets of the refrigerator in accordance with an embodiment of the present disclosure.

FIG. 10 is an exploded drawing illustrating doors and brackets of the refrigerator in accordance with an embodiment of the present disclosure.

As described above, the ice-making compartment door 31 and the dispenser door 41 may be rotatably coupled to the body 2. The ice-making compartment door 31 and the dispenser door 41 may be connected to the body 2 by use of brackets 90, 92, and 95.

The brackets may include an upper bracket 90, a lower bracket 92, and a connecting bracket 95. The upper bracket 90 is disposed at an upper portion of the ice-making compartment door 31, and the lower bracket 92 is disposed at a lower portion of the dispenser door 41. The connecting bracket 95 is disposed between the ice-making compartment door 31 and the dispenser door 41.

The upper bracket 90, the lower bracket 92, and the connecting bracket 95 may be fixed to the body 2. The upper bracket 90 includes an upper rotating shaft 91 rotatably coupled to the ice-making compartment door 31, and the lower bracket 92 includes a lower rotating shaft 96 rotatably coupled to the dispenser door 41. The connecting bracket 95 may include a first rotating shaft 93 rotatably coupled to the ice-making compartment door 31, and a second rotating shaft 94 rotatably coupled to the dispenser door 41.

That is, the ice-making compartment door 31 and the dispenser door 41 each may be rotated at the body 2 while sharing the single connecting bracket 92. In addition, the ice-making compartment door 31 and the dispenser door 41 may be installed to be rotated together by use of a pair of brackets.

Figure 11:
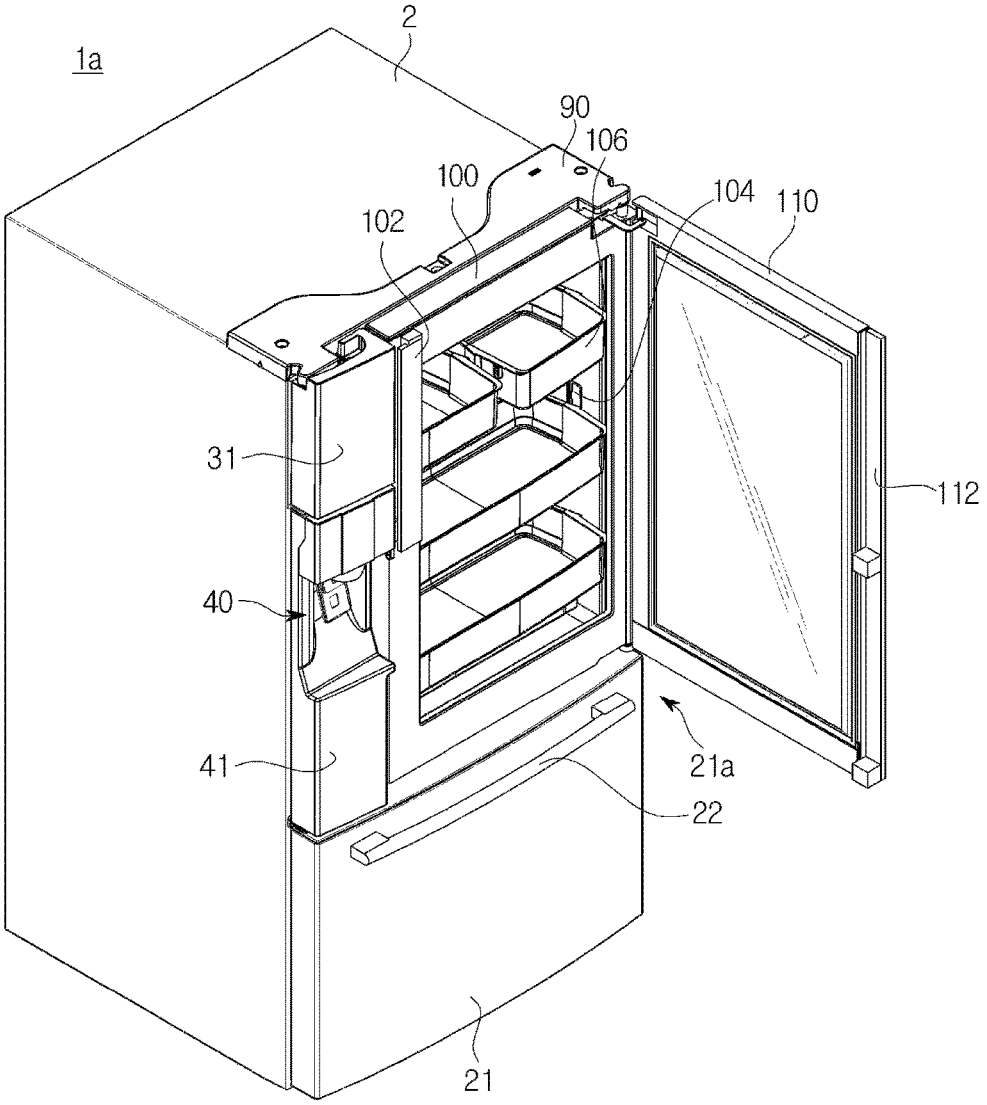
FIG. 11 and FIG. 12 are drawings illustrating a refrigerating compartment door of a refrigerator in accordance with an embodiment of the present disclosure.
Figure 12:
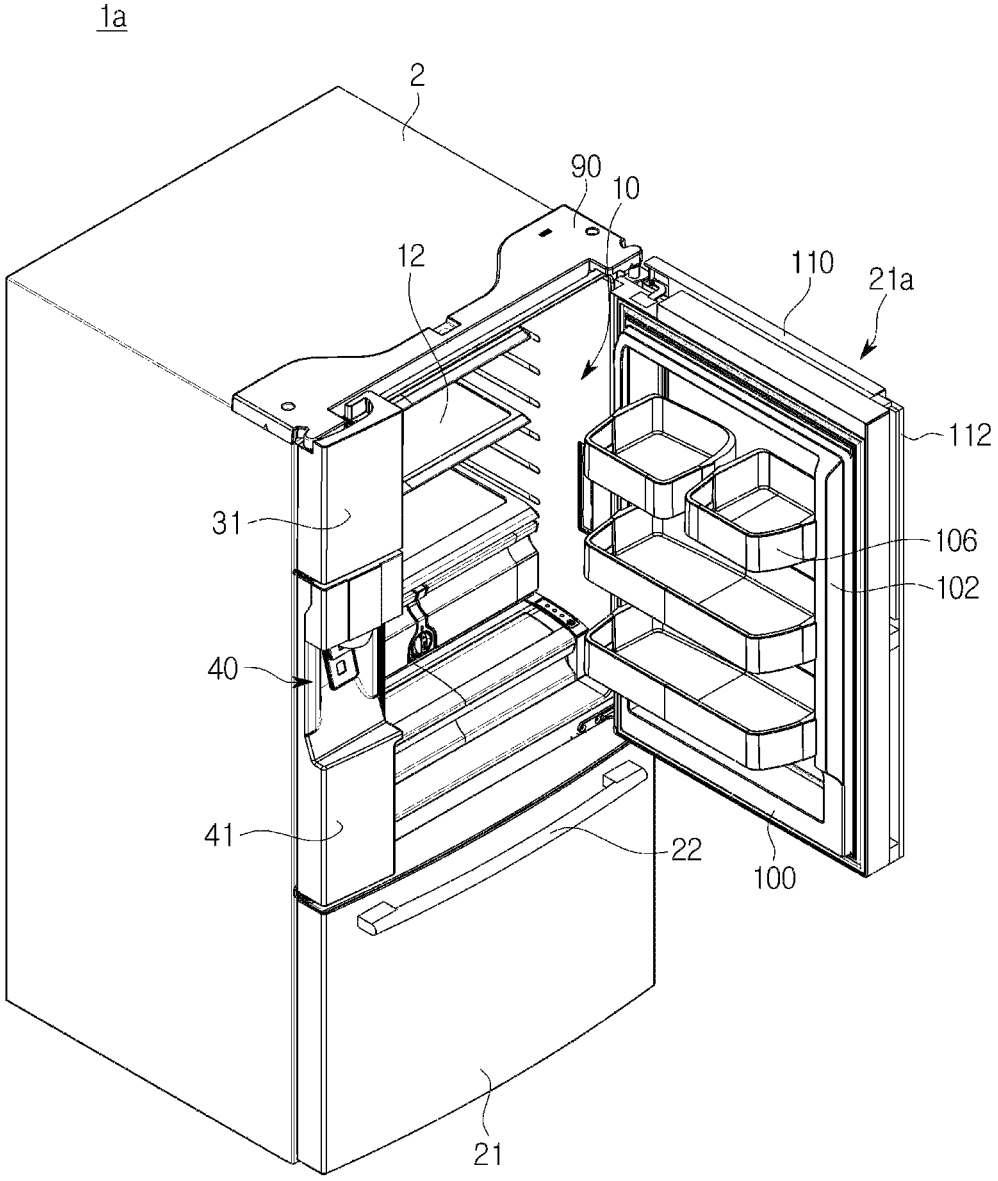

FIG. 11 and FIG. 12 are drawings illustrating a refrigerating compartment door of a refrigerator 1*a* in accordance with an embodiment of the present disclosure.

A refrigerating compartment door 21*a* may be provided having a first door 100 and a second door 110. The first door 100 and the second door 110 each may be rotatably installed on the body 2.

The first door 100 may be disposed to open/close an open front surface of the refrigerating compartment 10. The second door 110 may be rotatably disposed at a front of the first door 100. That is, the second door 110 is disposed to form an exterior appearance of a front surface of the body 2, and the first door 100 is adjacently disposed to the refrigerating compartment 10.

The first door 100 and the second door 110 may be rotated in a same direction, and are provided with rotating axes that are parallel with each other. However, the rotating axes of the first door 100 and the second door 110 are not positioned on an identical shaft, and each may be coupled to the body 2 by a hinge.

The first door 100 and the second door 110 may be provided with a first handle 102 and a second handle 112, respectively. The first handle 102 and the second handle 112 are parallelly provided toward an approximately perpendicular direction, and the first handle unit 102 may be disposed at an upper portion of the second handle 112.

The first door 102 may include an opening 104 provided with at least one door pocket 106. At the door pocket 106, food having relatively low height and small size or food frequently needed to be deposited/withdrawn may be stored. The door pocket 106 may be vertically installed at the opening 104. The door pocket 106 may be detachably installed at the opening 104.

The second door 112 is not provided with the opening 104, and may be provided with the shape of an approximately planar panel. Therefore, the second door 110 may open/close the opening 104 of the first door 100.

With respect to the usage motions of the first door 100 and the second door 110 having the structure as such in accordance with an embodiment of the present disclosure, as illustrated on FIG. 11, when the second door 110 is open, a user may deposit/withdraw the food stored at the door pocket 106 by approaching at the door pocket 106. At this time, the leakage of the cool air of the refrigerating compartment 10 may be reduced when compared to the state when the first door 100 is open.

As illustrated in FIG. 12, when the first door 100 is open, a user may deposit/withdraw the food stored at the shelf 12 by approaching inside the refrigerating compartment 10. At this time, of course, the food stored at the door pocket 106 may be deposited/withdrawn by approaching at the door pocket 106.

As the above, a refrigerator 1*a* in accordance with the embodiment of the present disclosure is provided such that food may be deposited/withdrawn by use of various methods according to the need of a user, and may be provided with an effect of minimizing the leak of cool air.

Figure 13:
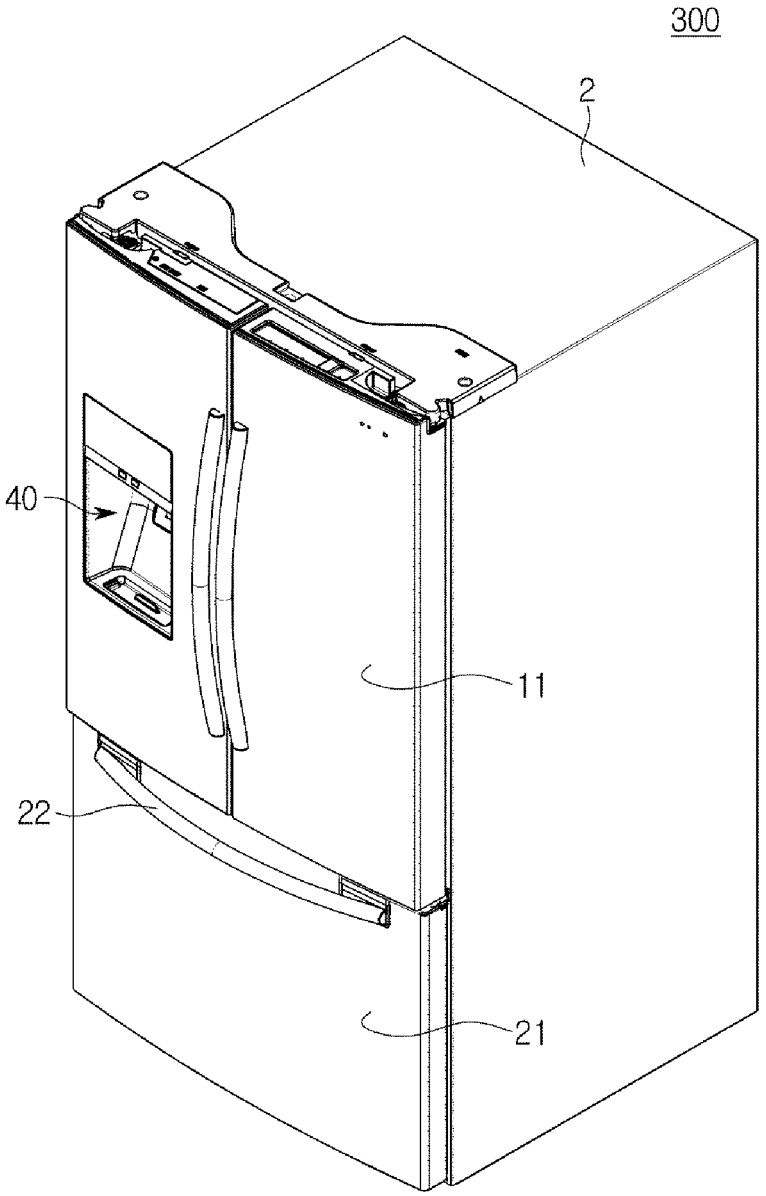
FIG. 13 is a perspective view illustrating an external appearance of a refrigerator in accordance with an embodiment of the present disclosure.
Figure 14:
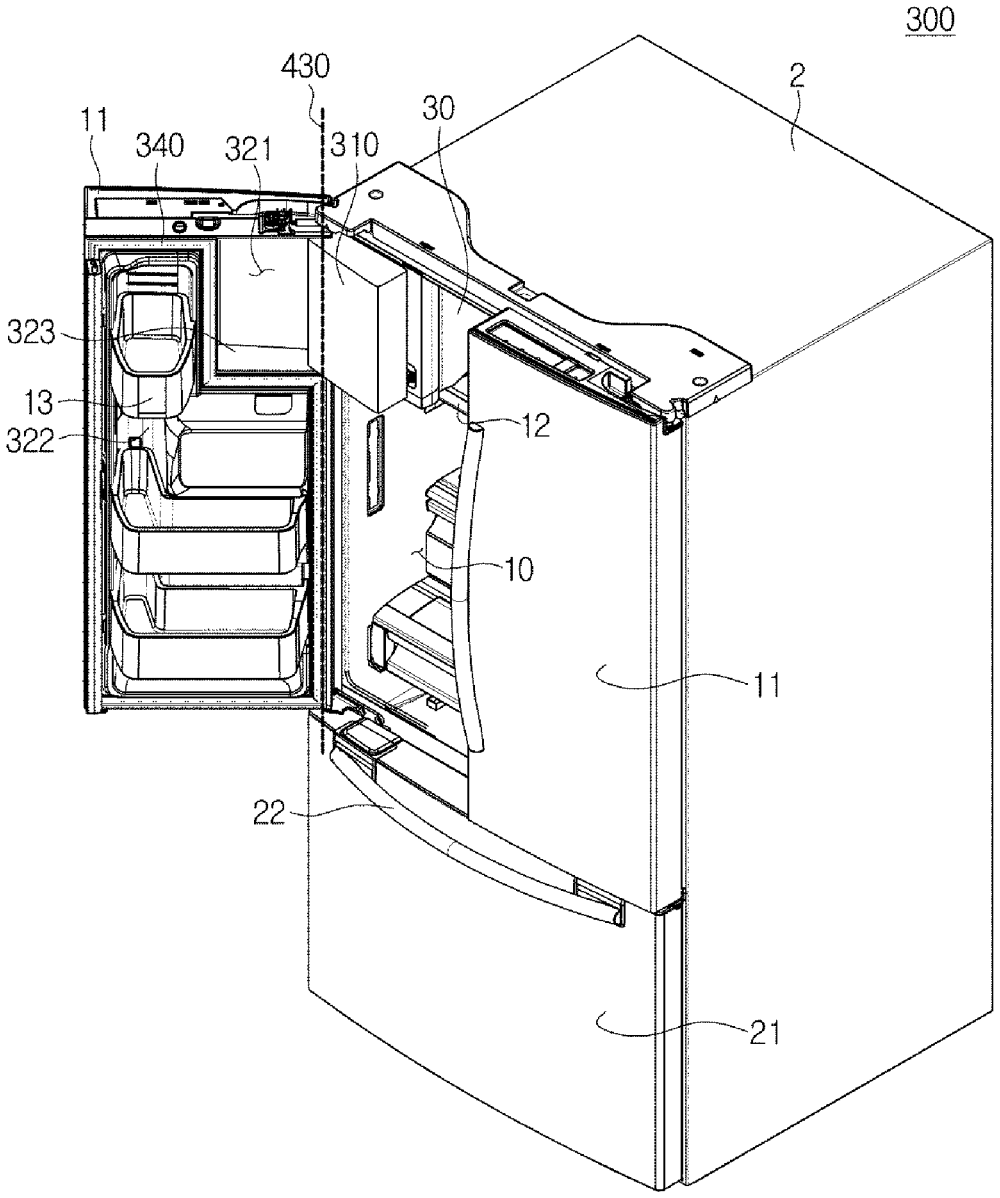
FIG. 14 is a perspective view illustrating a closed status of an ice making door of the refrigerator in accordance with an embodiment of the present disclosure.
Figure 15:
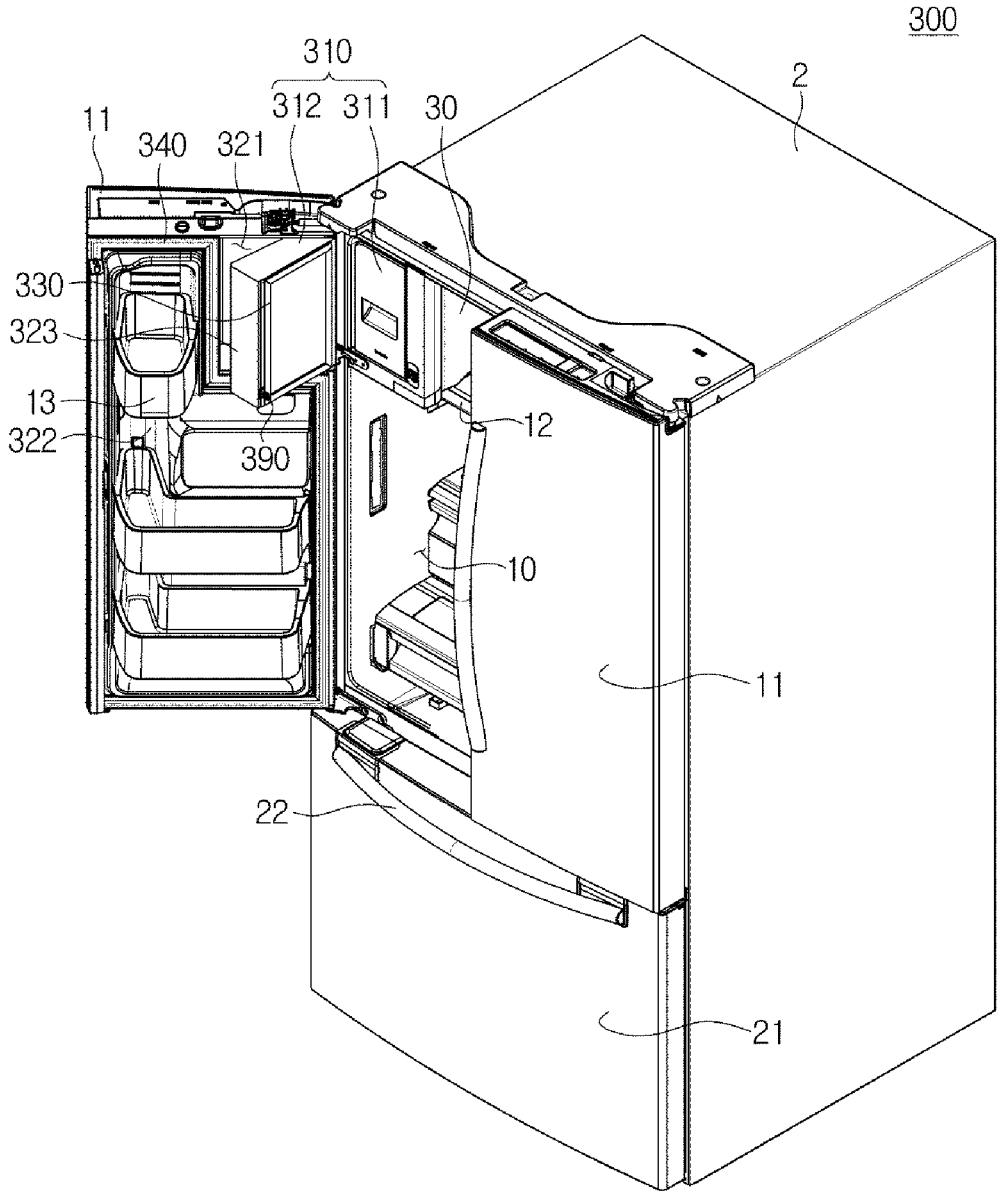
FIG. 15 is a perspective view illustrating an open status of the ice making compartment door of the refrigerator in accordance with an embodiment of the present disclosure.
Figure 16:
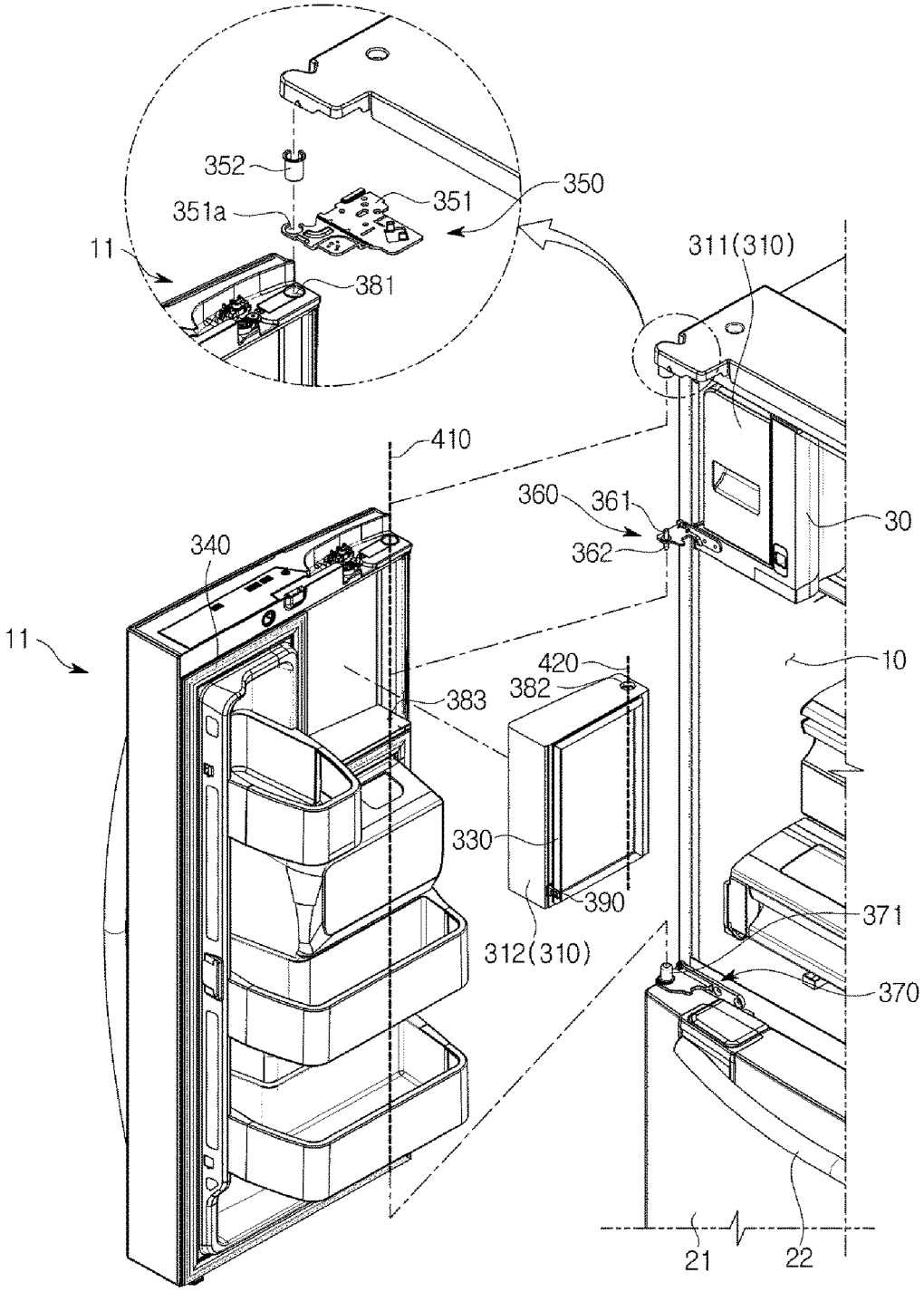
FIG. 16 is an exploded diagram illustrating a refrigerating compartment door, the ice making compartment door and a bracket in accordance with an embodiment of the present disclosure.

FIG. 13 is a perspective view illustrating an external appearance of a refrigerator 300 in accordance with an embodiment of the present disclosure, FIG. 14 is a perspective view illustrating a closed status of an ice making door of the refrigerator in accordance with an embodiment of the present disclosure, FIG. 15 is a perspective view illustrating an open status of the ice making compartment door of the refrigerator in accordance with an embodiment of the present disclosure, and FIG. 16 is an exploded diagram illustrating a refrigerating compartment door, the ice making compartment door and a bracket in accordance with an embodiment of the present disclosure. Hereinafter, the descriptions overlapping with FIG. 1 to FIG. 3 may be omitted. Hereinafter, the numeral notes of the drawings that are not shown will be referred to FIG. 1 to FIG. 3. Hereinafter, a first domain 321 may refer to a space of the ice-making compartment 321.

As illustrated from FIG. 13 to FIG. 16, the two units of the refrigerating compartment door 11 may be provided as to open/close the refrigerating compartment 10. In addition, the freezing compartment 20 may be positioned below the refrigerating compartment 10. The refrigerator having the shape as such is referred to as a French Door Refrigerator (FDR). Hereinafter, an embodiment with respect to the French Door Refrigerator as such will be described.

A refrigerator 300 may include the body 2 forming an external appearance. The body 2 may include the inside case 3, and the outside case 4 coupled to an outside of the inside case 3.

The inside case 3 and the outside case 4 may form an inside space while spaced apart from each other by a predetermined interval. The insulating material 5 may be disposed at the inside space. The insulating material may be formed of foamed urethane foam. The insulating material 5 may be formed by foaming and hardening urethane concentrated solution after the urethane solution is injected into the inside space 5 formed after the inside case 3 and the outside case 4 are coupled to each other.

The refrigerator 300 may further include the storage compartments 10 and 20 formed inside the body 2.

The inside case 3 may form the storage compartments 10 and 20. The inside case 3 may be molded by use of resin material. The outside case 4 is provided to form an external appearance, and may be formed by use of metallic material as to be provided with finish and durability.

The storage compartments 10 and 20 may store foods while provided inside the body 2. The storage compartments 10 and 20 may be divided vertically while having the storage partition 15 thereinbetween.

The storage compartments 10 and 20 may include the refrigerating compartment 10 and the freezing compartment 20. In detail, the storage compartments 10 and 20 divided by use of the storage partition 15 may include a refrigerating compartment 10 to refrigerate and store foods, and a freezing compartment 20 to freeze and store foods. The refrigerating compartment 10 and the freezing compartment 20 each may be provided with a front surface thereof open as to insert/remove food into/from by a user.

The refrigerator 300 may further include the doors 11 and 21. The doors 11 and 21 may be provided at front opening units of the storage compartments 10 and 20 to open/close the storage compartments 10 and 20. In other words, the doors 11 and 21 may be rotatably installed at the body 2 to open/close the refrigerating compartment 10 and the freezing compartment 20. The doors 11 and 21 may include the refrigerating compartment door 11 and the freezing compartment door 21 provided at front surfaces of the refrigerating compartment 10 and the freezing compartment 20, respectively.

The refrigerating compartment door 11 and the freezing compartment door 21 may be individually coupled to the body 2 to open/close the refrigerating compartment 10 and the freezing compartment 20, respectively. The refrigerating compartment door 11 may open/close the refrigerating compartment 10 while rotatably installed at the body 2. The freezing compartment door 21 may open/close the freezing compartment 20 while slidably installed at the body 2. The freezing compartment door 21 may be disposed at a lower portion of the refrigerating door 11.

The at least one shelf 12 is provided to structure the refrigerating compartment 10 into several shelves so that the storing of material may be convenient. In addition, the at least one door pocket 13 provided to accommodate stored material may be provided at the inner wall of the refrigerating compartment door 11.

The freezing box 23 may be installed at the freezing compartment 20 to store stored material. The freezing box 23 may be coupled to the freezing compartment door 21 so that the freezing box 23 may be slidably moved along with the freezing compartment door 21. In addition, the handle 22 may be provided at a front surface of the freezing compartment door 21 for a user to grab.

The refrigerator 300 may further include the ice-making compartment 30 provided inside the body 2 as to have an independent space from the storage compartments 10 and 20. The ice-making compartment 30 may be formed as an insulated space separated from the storage compartments 10 and 20. In addition, the ice-making compartment 30 may be open/closed by use of an ice-making compartment door 310. That is, the ice-making compartment 30 may be provided as an independent compartment with respect to the refrigerating compartment 10 and the freezing compartment 20.

The refrigerator 300 may further include the ice-making compartment door 310 provided to open/close the ice-making compartment 30. The ice-making compartment door 310 may be provided between the refrigerating compartment door 11 and the body 2.

The ice-making compartment door 310 may be rotatably installed between the refrigerating compartment door 11 and the body 2. At this time, the mounting space of the ice-making compartment 321 may be provided at an inner wall of the refrigerating compartment door 11 so that the ice-making compartment door 310 may be mounted to face the ice-making compartment 30. A gasket 330 may be installed at least at one of the ice-making compartment 30 and the ice-making compartment door 310 to seal the ice-making compartment 30. The gasket 330, in a case when the ice-making compartment 30 is closed by the ice-making compartment door 310, is provided to perform a role to shut off the flow of cool air between the ice-making compartment 30 and the storage compartments 10 and 20 by blocking a gap in between the ice-making compartment 30 and the ice-making compartment door 310. The gasket 330 may be formed by use of the material having superior sealing performance and elasticity such as rubber and silicon. However, the material of the gasket 330 is not limited to the above example, and may be variously changed.

A rotating shaft 410 of the refrigerating compartment door 11 and a rotating shaft 420 of the ice-making compartment door 310 may be positioned at a coaxial line.

The refrigerator 300 may further include a bracket 350. The bracket 350 is provided to form a rotating shaft 430 so that the refrigerating compartment door 11 and the ice-making compartment door 310 may be rotated while having the coaxial line as a center, and may connect the body 2 to at least one of the refrigerating compartment door 11 and the ice-making compartment door 310.

The bracket 350 may include a first body 351 and a second body 352. The first body 351 is fixed to the body 2, and may be provided with a fastening hole 351*a*. The second body 352 is provided to connect the refrigerating compartment door 11 to the ice-making compartment door 310 while coupled to the fastening hole 351*a*, and may form the rotating shaft 430. The second body 352 may be in the shape of a pillar. The second body 352 coupled to the fastening hole 351*a* may connect the refrigerating compartment door 11 and the ice-making compartment door 310 to the body 2 while coupled to a second opening 382 after passing through a first opening 381. The first opening 381 may be formed at one side surface of the refrigerating compartment door 11 that corresponds to the mounting space of the ice-making compartment 321. The second opening 382 may be formed at one side surface of the ice-making compartment door 310 to face the first opening 381.

The doors 11 and 21 may form an overall external appearance of the refrigerator 300 by being coupled to the body 2. In detail, the refrigerating compartment door 11, the freezing compartment door 21, and the body 2 may form an external appearance of the refrigerator 300 by being coupled to each other.

The inner wall of the refrigerating compartment door 11 may include the first domain 321 and the second domain 322. The first domain 321 refers to a portion at which the ice-making compartment door 310 is mounted to face the ice-making compartment 30. The second domain 322 refers to a portion at which the at least one door pocket 13 is disposed.

The inner wall of the refrigerating compartment door 11 may further include a partition wall 323 to divide the first domain 321 and the second domain 322 so that the first domain 321 and the second domain 322 may be isolated with respect to each other. At the second domain 322, a gasket 340 may be installed along the borders of the second domain 322 so that the storage compartments 10 and 20 may be sealed. The gasket 340 may be formed by use of the material having superior sealing performance and elasticity such as rubber and silicon. However, the material of the gasket 340 is not limited to the above example, and may be variously changed.

The refrigerator 300 may further include a first bracket 360 and a second bracket 370. The first bracket 360 may be disposed between the bracket 350 and the second bracket 370. The first bracket 360 may be disposed at a lower portion of the ice-making compartment door 310 so that the ice-making compartment door 310 may be prevented from being completely separated or exited from the refrigerating compartment door 11. The first bracket 360 may be fixed at the body 2 adjacent to the ice-making compartment door 310. The first bracket 360 may include an upper pin 361 and a lower pin 362. The upper pin 361 may form the rotational shaft 420 of the ice-making compartment door 310 together with the second body 352 of the bracket 350. In other words, the upper end portion of the ice-making compartment door 310 is coupled to the second body 352 of the bracket 350, and the lower end portion of the ice-making compartment door 310 may be coupled to the upper pin 361 of the first bracket 360. The lower pin 362 may be coupled to a third opening 383. The third opening 383 may be formed at the partition wall 323 which is provided to face the lower end portion of the ice-making compartment door 310.

The second bracket 370 may be disposed between the refrigerating compartment door 11 and the freezing compartment door 21. In other words, the second bracket 370 may be disposed at a lower portion of the refrigerating compartment door 11. The second bracket 370 may be fixed at the body 2. The second bracket 370 may include a pin 371 into which the refrigerating compartment door 11 is rotatably coupled. The pin 371 may form the rotating shaft 410 of the refrigerating compartment door 11 together with the second body 352 of the bracket 350. In detail, the upper end portion of the refrigerating compartment door 11 is coupled to the second body 352 of the bracket 350, and the lower portion of the refrigerating compartment door 11 may be coupled to the pin 371 of the second bracket 370.

The second body 352 of the bracket 350, the upper pin 361, and the lower pin 362 of the first bracket 360, and the pin 371 of the second bracket 371 may be positioned at a coaxial line.

The refrigerator 300 may further include a dispenser 40 to extract and withdraw ice that is made at the ice-making compartment 30.

Hereinabove, the descriptions are provided while focusing on a case of the ice-making compartment door 310 structured only by use of the second door 312. That is, the descriptions are provided in a case when the ice-making compartment door 310 is structured only by use of the second door 312.

The refrigerator 300 may further include the plurality of ice-making compartment doors 310 provided between the refrigerating compartment door 11 and the body 2 as to open/close the ice-making compartment 30.

The plurality of ice-making compartment doors 310 may include a first door 311 and a second door 312.

The first door 311 may be detachably installed at the ice-making compartment 30. In addition, the first door 311 may be slidably coupled to the ice-making compartment 30. The second door 312 may be rotatably installed at least one of the refrigerating compartment door 11 and the body 2 to face the first door 311.

The second door 312 may be installed to be separately rotated with respect to the refrigerating compartment door 11. That is, the second door 312 may be rotatably installed independently regardless of the rotations of the refrigerating compartment door 11.

The rotational shaft 410 of the refrigerating compartment door 11 and the rotational shaft 420 of the second door 312 may be positioned at a coaxial line.

The gasket 330 may be installed at least at one of the ice-making compartment 30 and the plurality of ice-making compartment doors 310 to seal the ice-making compartment 30. The gasket 330 may be formed by use of the material having superior sealing performance and elasticity such as rubber and silicon. However, the material of the gasket 330 is not limited to the above example, and may be variously changed.

Consequently, the ice-making compartment door 310 having at least one of the first door 311 and the second door 312 may be applied to the refrigerator 300. In addition, the ice-making compartment door 310 structured only by use of the plurality of second doors 312 may be applied to the refrigerator 300. In addition, the ice-making compartment door 310 structured only by use of the plurality of first doors 311 may be applied to the refrigerator 300. The number of the ice-making compartment door 310 is not limited to two units, and may variously be changed.

The opening/closing motions of the ice-making compartment door 310 are as follows.

As illustrated on FIG. 14, when a user opens the refrigerating compartment door 11, the ice-making compartment 30 is provided to be present in a state of being closed by use of the plurality of ice-making compartment doors 310. As illustrated on FIG. 15, when a user opens the second door 312 from the plurality of ice-making compartment doors 310, the ice-making compartment 30 is provided to be present in a state of being closed by use of the first door 311. When a user opens the first door 311 from the plurality of ice-making compartment doors 310, the ice-making compartment 30 is provided to be in an open state. As described above, the second door 312 is rotatably installed and the first door 311 may be slidably installed. However, the installation of the plurality of ice-making compartment doors 310 is not limited to the above examples, and may variously be changed. As an example, the first door 311 and the second door 312 may all be rotatably installed.

As the opening/closing of the ice-making compartment 30 are implemented through the plurality of ice-making compartment doors 310, the sealing performance of the ice-making compartment 30 may further be improved. In addition, the flow of cool air between the ice-making compartment 30 and the storage compartments 10 and 20 may be efficiently blocked, and consequently, the ice-making compartment 30 may be used as an independently insulated space that is separated from the storage compartments 10 and 20. The second door 312 is provided to be present in a state of being locked at the ice-making compartment 30 by use of a locking unit 390. The locked state of the second door 312 is released when a user pushes the second door 312 toward the ice-making compartment 30.

From FIG. 13 to FIG. 16, the descriptions are provided while focusing on a case when the ice-making compartment 30 is installed inside the refrigerating compartment 10, but the ice-making compartment 30 is provided to be adequate when installed inside the one of the refrigerating compartment 10 and the freezing compartment 20, while the installation position of the ice-making compartment 30 is not limited to inside the refrigerating compartment 10.

Cooling efficiency can be improved by completely separating an ice-making compartment from a freezing compartment and a refrigerating compartment, and user convenience can be improved by separately installing an ice-making compartment door.

In addition, the ice-making compartment can be provided in a direct cooling method, and refrigerating compartment door can be provided into a first door and a second door.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A refrigerator, comprising:

a body;

a refrigerating compartment provided inside the body;

a freezing compartment positioned below the refrigerating compartment and provided inside the body;

an ice-making compartment provided inside the body and provided with an insulated space that is separated from the refrigerating compartment and the freezing compartment;

an ice-making compartment door provided to insulate the ice-making compartment and installed in the body to open/close the ice-making compartment by rotating about a first rotating shaft; and a dispenser door installed to open/close at least a portion of the refrigerating compartment by rotating about a second rotating shaft positioned on the same line with the first rotating shaft and including a dispenser installed on the dispenser door and provided to communicate with the ice-making compartment, wherein the dispenser door is disposed below the ice-making compartment door, so that the ice generated at the ice-making compartment is moved to the dispenser.

2. The refrigerator of claim 1, further comprising:

a refrigerating compartment door rotatably installed in the body to open/close the refrigerating compartment; and a freezing compartment door slidably installed in the body to open/close the freezing compartment.

3. The refrigerator of claim 2, wherein:

the ice-making compartment door and the refrigerating compartment door are disposed in parallel with each other, and the freezing compartment door is disposed below the ice-making compartment door and the refrigerating compartment door.

4. The refrigerator of claim 1, further comprising:

brackets connecting the ice-making compartment door and the dispenser door to the body, wherein the brackets comprise a connecting bracket disposed between the ice-making compartment door and the dispenser door.

5. The refrigerator of claim 4, wherein:

the connecting bracket comprises the first rotating shaft rotatably coupled to the ice-making compartment door and the second rotating shaft rotatably coupled to the dispenser door.

6. The refrigerator of claim 1, wherein:

each of the ice-making compartment door and the dispenser door comprises a gasket extended along borders of the ice-making compartment door and the dispenser door.

7. The refrigerator of claim 1, wherein:

the ice-making compartment door and the dispenser door are installed in the body to be rotated together.

8. The refrigerator of claim 1, further comprising:

a drawer positioned at a lower surface of the dispenser door and slidably installed in the refrigerating compartment.

9. The refrigerator of claim 1, wherein:

an ice-making unit provided to generate ice and a refrigerant pipe provided to directly supply cooling energy to the ice-making unit are disposed inside the ice-making compartment.

10. The refrigerator of claim 2, wherein:

the refrigerating compartment door comprises a first door having an opening provided with at least one door pocket, and a second door disposed at a front of the first door to open/close the opening.

11. A refrigerator, comprising:

a storage compartment having a refrigerating compartment and a freezing compartment;

doors including a refrigerating compartment door configured to open/close the refrigerating compartment and a freezing compartment door configured to open/close the freezing compartment;

an ice-making compartment provided as an independent space from the storage compartment;

an ice-making compartment door provided to form at least a portion of an exterior appearance of the refrigerator and installed to open/close the ice-making compartment by rotating about a first rotating shaft;

an ice-making unit disposed inside the ice-making compartment and provided such that ice is generated.

a refrigerant pipe to directly supply cooling energy to the ice-making unit while at least a portion of the refrigerant pipe is disposed inside the ice-making compartment, and a dispenser door installed to open/close at least a portion of the refrigerating compartment by rotating about a second rotating shaft positioned on the same line with the first rotating shaft and including a dispenser installed on the dispenser door and provided to communicate with the ice-making compartment to dispense from the ice-making compartment, wherein the dispenser door is disposed below the ice-making compartment door, so that the ice generated at the ice-making compartment is moved to the dispenser.

12. The refrigerator of claim 11, wherein:

the ice-making compartment is insulated from the storage compartment.

13. The refrigerator of claim 11, wherein the ice-making compartment door, the freezing compartment door, and the ice-making comapartment door form an exterior appearance of the refrigerator.

* * * * *